US011333431B2

(12) United States Patent
Park

(10) Patent No.: US 11,333,431 B2
(45) Date of Patent: May 17, 2022

(54) REFRIGERATOR

(71) Applicant: LG Electronics Inc., Seoul (KR)

(72) Inventor: Cheolsoon Park, Seoul (KR)

(73) Assignee: LG Electronics Inc., Seoul (KR)

( * ) Notice: Subject to any disclaimer, the term of this patent is extended or adjusted under 35 U.S.C. 154(b) by 313 days.

(21) Appl. No.: 16/556,955

(22) Filed: Aug. 30, 2019

(65) Prior Publication Data

US 2020/0072539 A1 Mar. 5, 2020

(30) Foreign Application Priority Data

Aug. 31, 2018 (KR) ..... 10-2018-0103811

(51) Int. Cl.

| | |
|---|---|
| ***F25D 29/00*** | (2006.01) |
| ***F25D 11/02*** | (2006.01) |
| ***F25D 23/02*** | (2006.01) |
| ***F25D 25/02*** | (2006.01) |

(52) U.S. Cl.

CPC ..... *F25D 29/003* (2013.01); *F25D 11/02* (2013.01); *F25D 23/021* (2013.01); *F25D 25/021* (2013.01); *F25D 25/025* (2013.01); *F25D 2325/021* (2013.01); *F25D 2500/06* (2013.01); *F25D 2700/00* (2013.01)

(58) Field of Classification Search

CPC ..... F25D 11/02; F25D 23/021; F25D 25/025; F25D 25/021; F25D 2700/00; F25D 2325/021; F25D 29/005; A47B 88/457; A47B 88/90; A47B 2088/901; A47B 2210/175; A47B 2210/0056

See application file for complete search history.

(56) References Cited

U.S. PATENT DOCUMENTS

| | | | | |
|---|---|---|---|---|
| 6,516,478 | B2 * | 2/2003 | Cook | A47C 19/045 108/147 |
| 7,396,093 | B2 * | 7/2008 | Jeong | A47B 46/00 312/402 |
| 8,015,638 | B2 * | 9/2011 | Shimada | A47C 19/045 5/611 |

(Continued)

FOREIGN PATENT DOCUMENTS

| | | |
|---|---|---|
| CN | 102226626 | 10/2011 |
| EP | 1621837 | 2/2006 |

OTHER PUBLICATIONS

EP Search Report in European Application No. EP 19194331, dated Jan. 22, 2020, 7 pages.

*Primary Examiner* — Lionel Nouketcha
(74) *Attorney, Agent, or Firm* — Fish & Richardson P.C.

(57) ABSTRACT

A refrigerator includes a cabinet defining a storage chamber, a drawer door, a rail that slidably couples the drawer door to the cabinet, a driving device provided in the door part, an elevation device provided in the drawer part to vertically ascend or descend at least a portion of the drawer part, and an elevation detection device. The drawer door includes a drawer part configured to be inserted into and withdrawn out of the storage chamber and a door part coupled to the drawer part and configured to open and close the storage chamber. The driving device includes a motor assembly, a screw assembly having a screw and a screw holder, and a lever that couples the screw holder to the elevation device and is configured to be rotated based on the movement of the screw holder along the screw.

20 Claims, 28 Drawing Sheets

(56) References Cited

U.S. PATENT DOCUMENTS

| | | | | |
|---|---|---|---|---|
| 8,172,347 | B2 * | 5/2012 | Lim | F25D 25/02 312/408 |
| 9,377,238 | B2 | 6/2016 | Hall et al. | |
| 2014/0265806 | A1 * | 9/2014 | Hall | F25D 25/025 312/408 |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2018-0103811 (Aug. 31, 2018), which is hereby incorporated by reference in its entirety.

BACKGROUND

The present disclosure relates to a refrigerator.

In general, refrigerators are home appliances for storing foods at a low temperature in a storage chamber that is covered by a door. For this, refrigerators cool the inside of the storage chamber by using cool air generated by being heat-exchanged with a refrigerant circulated through a refrigeration cycle to store foods in an optimum state.

Such a refrigerator is becoming larger and multifunctioned as dietary changes and user's preferences become more diverse, and thus, a refrigerator having various structures and convenience devices for user's convenience and freshness of stored foods has been introduced.

The storage chamber of the refrigerator may be opened/closed by the door. Also, refrigerators may be classified into various types according to an arranged configuration of the storage chamber and a structure of the door for opening and closing the storage chamber.

The refrigerator door may be classified into a rotation-type door that opens and closes a storage chamber through rotation thereof and a drawer-type door that is inserted and withdrawn in a drawer type.

Also, the drawer-type door is often disposed in a lower region of the refrigerator. Thus, when the drawer-type door is disposed in the lower region of the refrigerator, a user has to turn its back to take out a basket or foods in the drawer-type door. If the basket or the foods are heavy, the user may feel inconvenient to use the basket or may be injured.

In order to solve such a limitation, various structures are being developed in which the drawer-type door is capable of being elevated.

Representatively, a refrigerator in which a lifting mechanism for elevation a bin provided in a refrigerating compartment is disclosed in U.S. Pat. No. 9,377,238.

However, this technique according to related art may have a structure in which the lifting mechanism for the elevation is disposed and exposed outside the bin to cause a serious safety problem. Also, there is a limitation that an outer appearance is poor due to the structure of the lifting mechanism exposed to the outside.

Also, since a driving part is exposed to the outside, noise during operation of the driving part may be transmitted to the outside as it is, which may cause the user's dissatisfaction.

Also, since the lifting mechanism is disposed inside the refrigerator, storage capacity within the refrigerator may be significantly reduced. This may cause a limitation that storage efficiency of the refrigerator is greatly reduced due to the loss in storage capacity of the whole refrigerator.

Also, the lifting mechanism is provided inside the refrigerator. Thus, separation of the door and separation of the lifting mechanism are required for service of the lifting mechanism to deteriorate serviceability.

Also, a driving part of the lifting mechanism has a structure for elevating the bin by pushing one end of the support assembly. Therefore, when a large heavy structure or a heavy object is disposed inside the bin, sufficient force for the elevation may not be provided. Of course, although a motor of the driving part increases in size to solve this limitation, there are limitations that an internal volume loss and noise become larger, and the manufacturing cost increases.

Also, the lifting mechanism may support one side of the entire bottom surface of the bin due to the arrangement position of the driving part, and therefore, the deflected load is inevitably generated when the bin is filled with the stored product. Also, a serious limitation may arise in stability due to an eccentric load acting in a state in which the door is withdrawn, and the elevating operation may not be performed smoothly.

SUMMARY

Implementations provide a refrigerator in which an electric device for elevation is provided inside a door part, and a mechanical device for the elevating the drawer part is provided in a drawer part.

Implementations also provide a refrigerator which improves an outer appearance by preventing exposure of constituents for elevating a drawer part and improves safety.

Implementations also provide a refrigerator that is improved in assemblability and serviceability of a drawer door.

Implementations also provide a refrigerator which detects whether elevation of an elevation device is completed to prevent the malfunction and abnormal operation from occurring.

Implementations also provide a refrigerator in which a detection device for detecting an elevation state of an elevation device is capable of being simply disposed.

Implementations also provide a refrigerator which detects an operation of a driving device to confirm an elevation state of an elevation device.

Implementations also provide a refrigerator which is capable of preventing deflection from occurring by an eccentric load when the drawer part is elevated to ensure a stable elevation operation.

Implementations also provide a refrigerator in which electric device of the door part and a mechanism part for elevation of the drawer part are separated together when the door part and a drawer part are separated.

In one implementation, a refrigerator includes: a cabinet that defines a storage chamber; a door including a door part configured to open and close the storage chamber and a drawer part configured to provide a storage space; a rail configured to connect the door to the cabinet, the rail being configured to allow the door to be inserted or withdrawn therethrough; a driving device provided in the door part to provide power; and an elevation device provided in the drawer part, the elevation device being connected to the driving device to allow a portion of the drawer part to vertically move, wherein the driving device includes: a motor assembly; a screw unit including a screw that rotates by the motor assembly and a screw holder elevated along the screw; and a lever configured to connect the screw holder to the elevation device, the lever rotating by the elevation of the screw holder, wherein an elevation detection device configured to detect an operation state of the driving device to determine whether the elevation device completely ascends or descends is disposed on one side of the driving device.

The elevation detection device may detect a maximum height and a minimum height of the screw holder to determine whether the elevation device completely ascends or descends.

The screw holder may include: a housing configured to accommodate the screw and the screw holder; and a cover member configured to open and close an opened one side of the housing, wherein the elevation detection device is disposed on the cover member.

The elevation detection device may include: a support plate disposed in an extension direction of the screw; and a pair of detection sensors disposed on both sides of the support plate, the pair of detection sensors being disposed at positions corresponding to the uppermost position and the lowermost position in a moving path of the screw holder.

A magnet may be disposed on the screw holder, and each of the detection sensors may include a hall sensor configured to detect the magnet.

The support plate may include a substrate on which the detection sensors are mounted.

The substrate may have a length greater than a stroke of the screw holder.

The elevation detection device may define at least a portion of an outer appearance of the screw unit and include a case configured to accommodate the support plate.

A connector mounting part on which a connector connected to the pair of detection sensors is mounted may be disposed on one side of the case, and the connector may be connected to an electric wire, which is exposed to the outside, through the connector mounting part.

A pair of screw assemblies may be disposed on both left and right sides with respect to the motor assembly, and the lever may be connected to each of the pair of screw assemblies to provide power to both sides of the elevation device at the same time.

The elevation detection device may be disposed on one screw unit of both the screw units.

The elevation detection device may be disposed on each of both the screw units.

The screw units may be disposed symmetrical to each other on both sides with respect to the motor assembly, and both the screw units may be disposed to be inclined in a direction that is gradually away from each other toward an upper side.

The elevation detection device may be disposed in a rotation path of the lever to detect a position of the lever.

The elevation detection device may include a switch contacting the lever.

The elevation detection device may include: an upper detection device contacting the lever at a position corresponding to the uppermost rotation position of the lever; and a lower detection device contacting the lever at a position corresponding to the lowermost rotation position of the lever.

A pair of screw assemblies may be disposed on both left and right sides with respect to the motor assembly, and the lever may be connected to each of the pair of screw assemblies to provide power to both sides of the elevation device at the same time.

The elevation detection device may be disposed in a rotation path of one lever of both the levers.

An accommodation part may be provided in a rotation shaft of the lever, and a coupling part that is detachably coupled to the accommodation part may be disposed on the elevation device.

A door cover configured to cover the driving device may be disposed on a rear surface of the door part, a cover opening that is opened at a position corresponding to the accommodation part may be defined in the door cover, and a drawer opening disposed at a position corresponding to the coupling part may be defined in a front surface of the drawer part.

The details of one or more implementations are set forth in the accompanying drawings and the description below. Other features will be apparent from the description and drawings, and from the claims.

DETAILED DESCRIPTION OF THE IMPLEMENTATIONS

Figure 1:
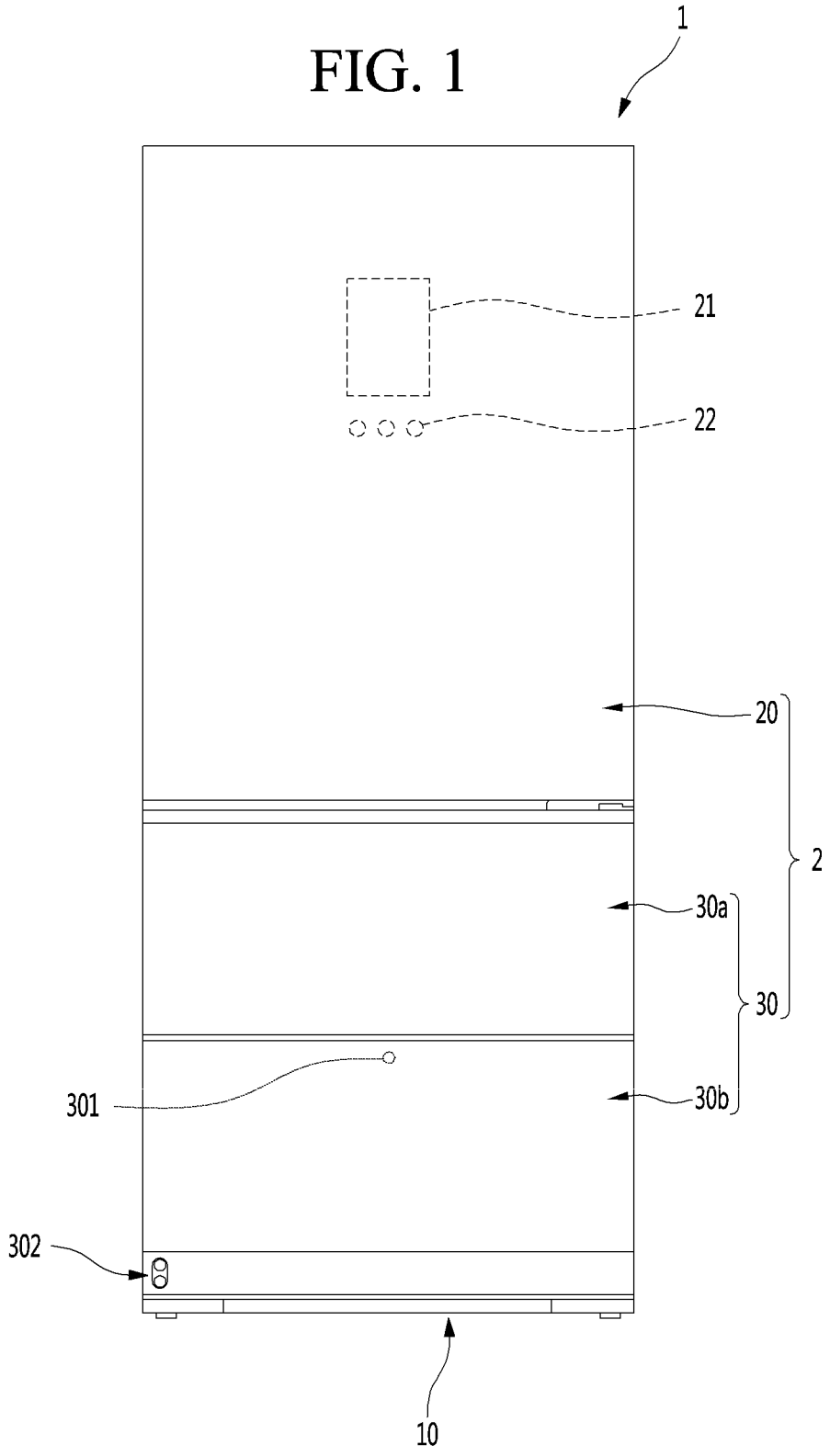
FIG. 1 is a front view of a refrigerator according to an implementation.

Hereinafter, some implementations of the present disclosure will be described in detail with reference to the accompanying drawings. It should be noted that when components in the drawings are designated by reference numerals, the same components have the same reference numerals as far as possible even though the components are illustrated in different drawings. Further, in description of implementations of the present disclosure, when it is determined that detailed descriptions of well-known configurations or functions disturb understanding of the implementations of the present disclosure, the detailed descriptions will be omitted.

Also, in the description of the implementations of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected % coupled" or "joined" to the latter with a third component interposed therebetween.

FIG. 1 is a front view of a refrigerator according to an implementation. Also, FIG. 2 is a schematic view illustrating an elevation state of a lower drawer door of the refrigerator according to an implementation.

Figure 2:
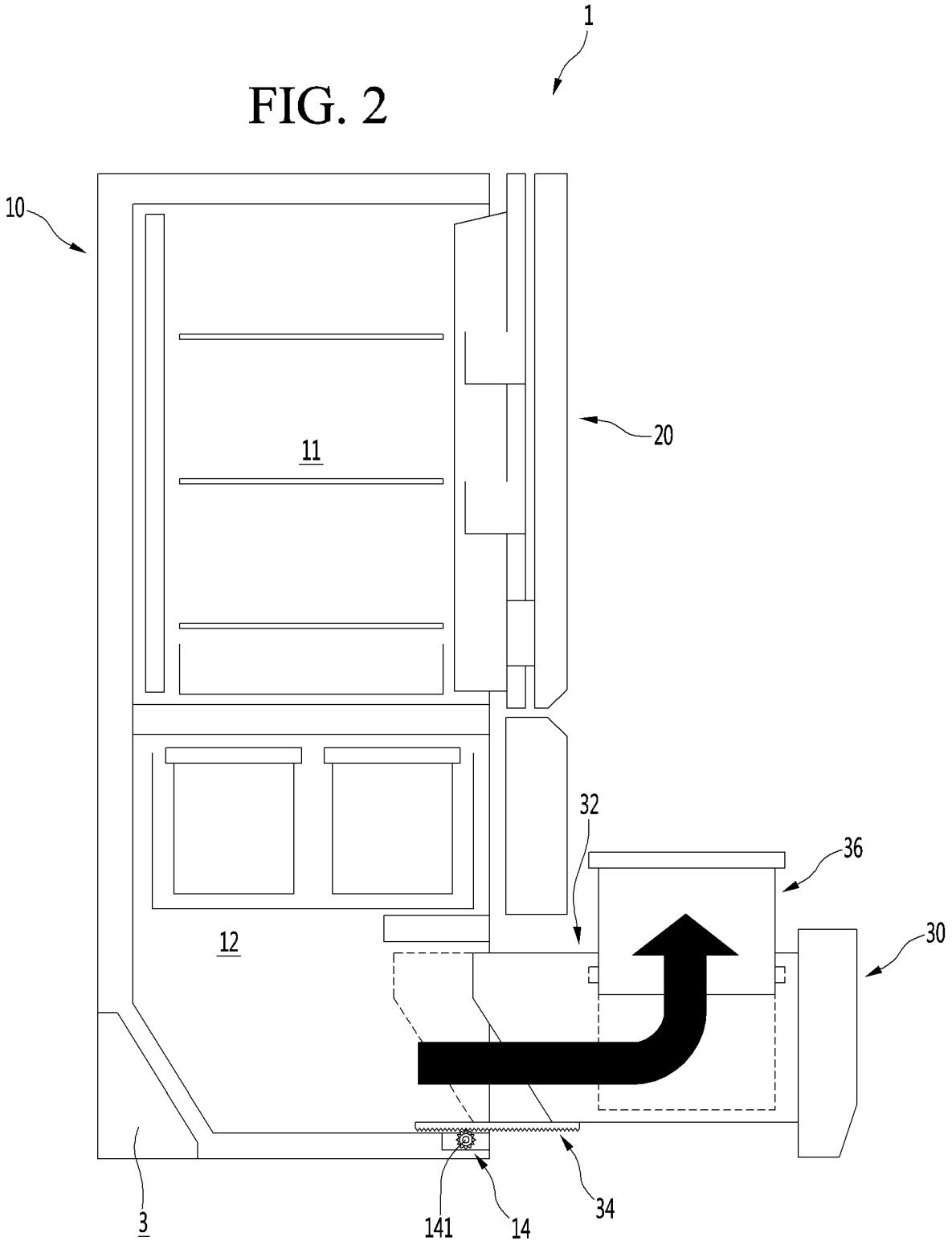
FIG. 2 is a schematic view illustrating an elevation state of a lower drawer door of the refrigerator according to an implementation.

Referring to FIGS. 1 and 2, a refrigerator 1 may have an outer appearance that is defined by a cabinet 10 defining a, storage chamber and a door 2 covering an opened front surface of the cabinet 10.

The storage chamber of the cabinet 10 may be divided into a plurality of spaces. For example, an upper space 11 of the cabinet 10 may be provided as a refrigerating compartment, and a lower space, or lower storage chamber, 12 may be provided as a freezing compartment. Each of the upper space and the lower space may be provided as an independent space that is maintained at a different temperature, except for the refrigerating compartment and the freezing compartment. The upper space and the lower space may be called an upper space and a lower space.

The door 2 may be constituted by a rotation door 20 opening and closing the upper space through rotation thereof and a drawer door 30 opening and closing the lower space by being inserted or withdrawn in a drawer manner. The lower space may be vertically divided again. The drawer door 30 may be constituted by an upper drawer door 30*a* and a lower drawer door 30*b*.

Also, an outer appearance of each of the rotation door 20 and the drawer door 30 may be made of a metal material and be exposed to the front side.

Although the refrigerator in which all of the rotation door 20 and the drawer door 30 are provided is described, the present disclosure is not limited thereto. For example, the present disclosure may be applied to all refrigerators including a door that is inserted and withdrawn in the drawer type. Also, the rotation door 20 may be provided at an upper portion and thus called an upper door, and the drawer door 30 may be provided at a lower portion and thus called a lower door.

A display 21 may be disposed on one side of a front surface of the rotation door 20. The display 21 may have a liquid crystal display structure or a 88 segment structure.

Also, when the outer appearance of the door 2 is made of the metal material, a plurality of fine holes are punched in the display 21 to display information by using light passing therethrough.

Also, a manipulation part 22 that is capable of manipulating automatic rotation or withdrawal of the upper door 2 or the lower door 2 may be provided on one side of the rotation door 20.

The manipulation part 22 may be integrated with the display 21 and may operate in a touch manner or a button manner. The manipulation part 22 may input a command with respect to an overall operation of the refrigerator 1 and manipulate an insertion and withdrawal of the drawer door 30 or an elevation within the drawer door.

A manipulation part 301 may also be provided on the drawer door 30. The manipulation part 301 may be disposed on one side of the lower drawer door 30*b*, which is disposed at the lowermost portion, of the drawer door 30. The manipulation part 301 may operate in a touch or button manner. The manipulation part 301 may be provided as a sensor detecting proximity or movement of the user or provided as an input unit that operates by a user's motion or voice.

As illustrated drawing, a manipulation device 302 may be disposed on a lower end of the lower drawer door 30*b* to illuminate an image on a bottom surface and thereby to output a virtual switch and to input an operation in such a manner that the user approaches a corresponding area.

The lower drawer door 30*b* may be automatically inserted and withdrawn according to the manipulation of the manipulation part 301. Also, a food or container within the lower drawer door 30*b* may be elevated in a state in which the lower drawer door 30 is withdrawn by the manipulation of the manipulation part 301.

That is, the automatic insertion and withdrawal and/or automatic elevation of the lower drawer door 30*b* may be performed by at least one of a plurality of manipulation devices 22, 301, 302, and 303. As necessary, only one of the plurality of manipulation devices 22, 301, 302, and 303 may be provided.

The manipulation devices 22, 301, 302, and 303 may be used to insert/withdraw and elevate the drawer door 30. Also, the insertion/withdrawal and the elevation may be performed by a combination or sequential operation of the plurality of manipulation devices 22, 301, 302, and 303.

To accommodate the foods accommodated in the lower drawer door 30*b*, the lower drawer door 30*b* may be withdrawn forward to allow the container 36 within the lower drawer door 30*b* to be elevated.

The container 36 may have a predetermined height. Since the container 36 is seated on the elevation device 80 that will be described later, the height of the container 36 may increase by the height of the elevation device 80 when the elevation device 80 is elevated. Thus, when the elevation device 80 ascends, the container 36 may be disposed at a point at which the user is easily accessed to the container 36 and also easily lift the container 36.

Thus, the container 326 may be completely accommodated in the accommodation part 32 when the lower drawer door 30*b* is inserted and withdrawn. When the elevation device ascends, the container 36 may be disposed at a higher position than the lower storage chamber 12.

Although the shape of the container 36 is not limited, the container 36 may have a shape corresponding to the size of a front space (see reference symbol S1 of FIG. 3) and may have a predetermined height to prevent the stored food from being separated when the elevation device 80 ascends.

The food or container 36 inside the drawer door 30 disposed at the lowest position may be more easily lifted and used through the above-described manipulation.

The lower drawer door 30*b* may be automatically inserted and withdrawn forward and backward by the draw-out motor 14, the pinion 141 provided in the cabinet 10, and the draw-out rack 34 provided on the bottom surface of the lower drawer door 30*b*.

Also, the container inside the lower drawer door 30*b* may be elevated by the driving device 40 and the elevation device 80 provided in the lower drawer door 30*b*.

Hereinafter, the lower drawer door 30*b* and an operation of the lower drawer door 30*b* will be described in more detail, and also, the lower drawer door 30*b* will be called a drawer door or a door unless otherwise specified.

The implementations are not limited to the number and shape of the drawer doors and may be applied to all refrigerators having a door that is inserted and withdrawn in a drawer type into/from the lower storage chamber.

Figure 3:
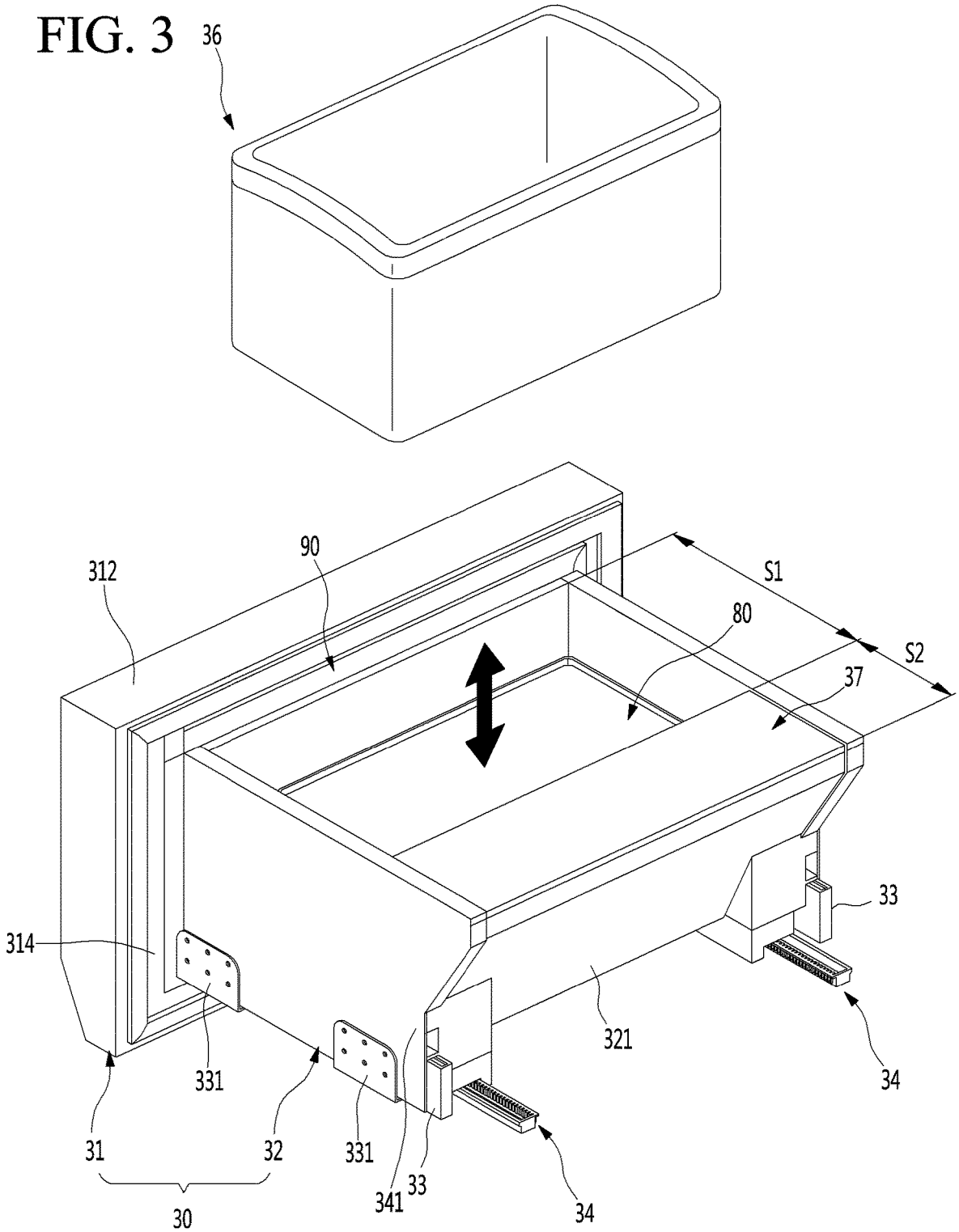
FIG. 3 is a perspective view illustrating a state in which a container of the lower drawer door is separated.
Figure 4:
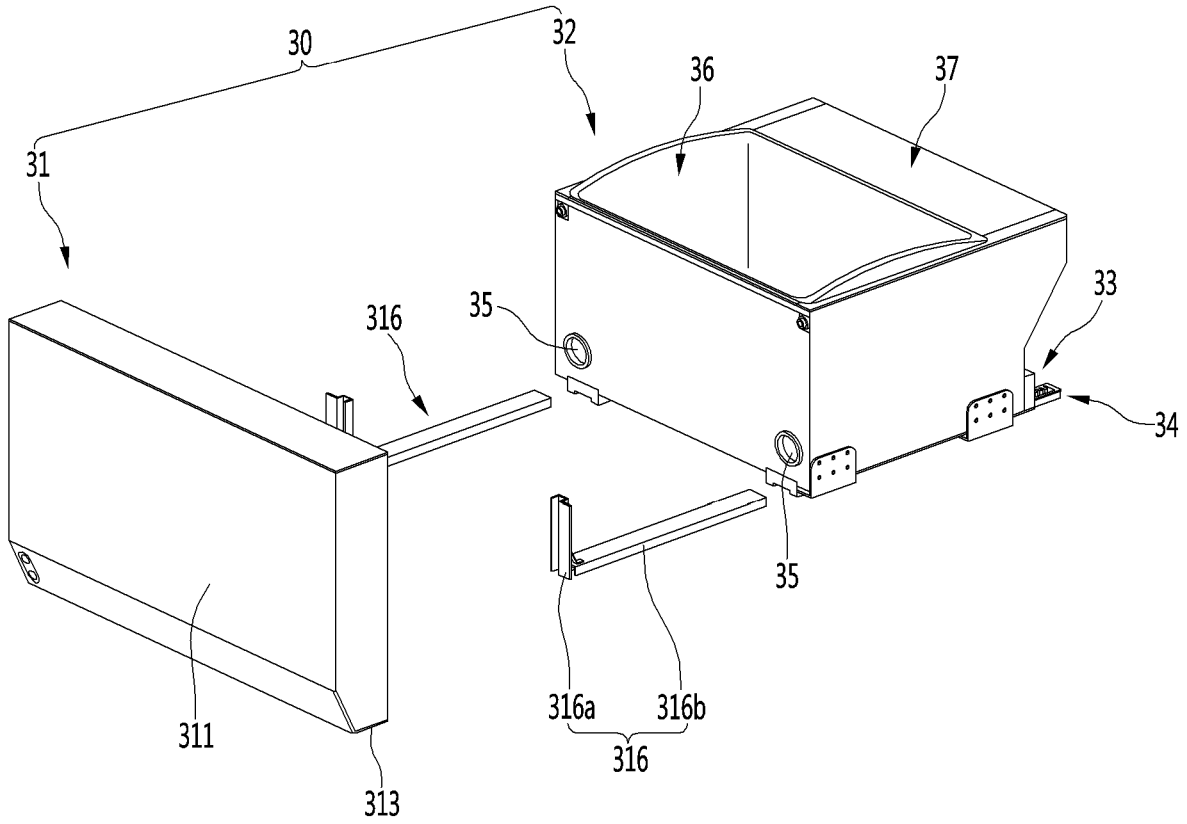
FIG. 4 is an exploded perspective view illustrating a state in which a drawer part of the lower drawer door and a door part are separated from each other when viewed from a front side.

FIG. 3 is a perspective view illustrating a state in which a container of the lower drawer door is separated. Also, FIG. 4 is an exploded perspective view illustrating a state in which the drawer part of the lower drawer door and the door part are separated from each other when viewed from a front side.

Referring to FIGS. 1 to 4, the door 30 may include a door part 31 opening and closing the storage chamber and a drawer part 32 coupled to a rear surface of the door part 31 and inserted and withdrawn together with the door part 31.

The door part 31 may be exposed to the outside of the cabinet 10 to define an outer appearance of the refrigerator 1, and the drawer part 32 may be disposed inside the cabinet 10 to define an storage chamber. Also, the door part 31 and the drawer part 32 may be coupled to each other and be inserted and withdrawn forward and backward together with each other.

The drawer part 32 may be disposed on the rear surface of the door part 31 to define a space in which the food or container to be stored is accommodated. The inside of the drawer part 32 may provide an upwardly opened storage chamber, and an outer appearance of the drawer part 32 may be defined by a plurality of plates (see reference numerals 391, 392, and 395 in FIG. 13).

Each of the plurality of plates 391, 392, and 395 may be made of a metal material and provided inside and outside the drawer part 32 so that the entire drawer part 32 is made of stainless steel or a material having a texture such as stainless steel.

In the state in which the door 30 is inserted, a machine room 3 in which a compressor and a condenser constituting a refrigeration cycle are provided may be disposed behind the door 30. Thus, a rear end of the drawer part 32 may have a shape of which an upper end further protrudes from a lower end, and an inclined surface 321 may be provided on a rear surface of the drawer part 32.

Also, a draw-out rail 33 guiding the insertion and withdrawal of the door 30 may be provided on each of both side surfaces of the drawer part 32. The door 30 may be mounted to be inserted into or withdrawn from the cabinet 10 by the draw-out rail 33. The draw-out rail 33 may be covered by an outer side plate 391 and thus may not be exposed to the outside. The draw-out rail 33 may have a rail structure that is capable of extending in multistage.

A rail bracket 331 may be provided in the draw-out rail 33, and the rail bracket 331 may extend from one side of the draw-out rail 33 to both sides of the drawer part 32. Also, the rail bracket 331 may be fixedly coupled to a sidewall surface inside the refrigerator. Thus, the drawer part 32, that is, the door 30, may be mounted to the cabinet 10 by the draw-out rails 33.

Also, the draw-out rail 33 may be disposed on a lower end of each of both surfaces of the drawer part 32. Also, lower ends of both side surfaces of the drawer part 32 may be mounted to be seated from an upper side of the draw-out rail 33. Thus, the draw-out rail 33 may be called an under rail.

A draw-out rack 34 may be disposed on the bottom surface of the drawer part 32. The draw-out rack 34 may be disposed on each of both sides and be interlocked with an operation of a draw-out motor 14 mounted on the cabinet 10 to automatically insert and withdraw the door 30. That is, when an operation is inputted into the manipulation parts 22 and 301, the draw-out motor 14 may be driven to insert and withdraw the door 30 according to movement of the draw-out rack 34. Here, the door 30 may be stably inserted and withdrawn by the draw-out rail 33.

The draw-out rack 34 may not be provided on the drawer part 32. Here, the user may hold a side of the door part 31 to push and pull the door part 31 so that the door 30 is directly inserted and withdrawn.

The inside of the drawer part 32 may be divided into a front space S1 and a rear space S2. The elevation device 80 that is vertically elevated and a container seated on the elevation device 80 to be elevated together with the elevation device 80 may be disposed in the front space S1.

Although the container 36 is illustrated in the form of a basket having an opened upper portion, the container 36 may have a closed box structure such as a kimchi box. Also, a plurality of containers 36 may be stacked or arranged in parallel to each other.

Also, when the door 30 is withdrawn, the entire drawer part 32 may not be withdrawn to the outside of the storage chamber due to a limitation in draw-out distance of the door 30. That is, at least the front space S1 is withdrawn to the outside of the storage chamber, and the whole or a portion of the rear space S2 is disposed inside the storage chamber within the cabinet 10.

In such a structure, a draw-out distance of the door 30 may be limited by the draw-out rack 34 or the draw-out rail 33. As the draw-out distance becomes longer, the moment applied to the door 30 may become larger in the draw-out state, and thus it is difficult to maintain a stable state, and the deformation or damage of the draw-out rail 33 or the draw-out rack 34 may occur.

The elevation device 80 and the container 36 may be accommodated in the front space S1. While the elevation device is elevated, the food or container 36 seated on the elevation device 80 may be elevated together. Also, the elevation device 80 may be provided below the container 36, and the elevation device 80 may be covered by the container 36 when the container 36 is mounted. Thus, any constituent of the elevation device 80 will not be exposed to the outside.

A separate drawer cover 37 may be provided in the rear space S2. The front space S1 and the rear space S2 may be partitioned by the drawer cover 37. In a state in which the drawer cover 37 is mounted, a space in which front and top surfaces of the rear space S2 are covered and not be used may be not be exposed to the outside.

The drawer cover 37 may be mounted to cover the rear space S2 when the door 30 is withdrawn. In the state in which the door 30 is withdrawn, only the front space S1 may be exposed to provide more clean outer appearance. Also, a remaining space except for the space in which the elevation device 80 and the container 36 are mounted may be covered to prevent the foods from dropping or being jammed in a gap during the elevation.

However, when the drawer cover 37 is separated, the user may be accessible to the rear space S2, and thus, foods may be easily accommodated in the rear space S2. To utilize the rear space S2, a separate pocket or a container corresponding to the shape of the rear space may be disposed in the rear space S2.

Also, the elevation device 80 inside the drawer part may be simply separated and mounted to utilize the entire space inside the drawer part 32, and the elevation device 80 and the drawer cover 37 may be separated from each other to utilize the entire space of the drawer part 32.

The outer appearance of each of the inner and outer surfaces of the drawer part 32 may be defined by the plates (see reference numerals 391, 392 and 395 of FIG. 12), which cover the components mounted on the drawer part 32, and thus, the outer and inner appearances may be seen to be neat. The plates (see reference numerals 391, 392, and 395 of FIG. 12) may be constituted by a plurality of plates and may be made of stainless steel to provide a more luxurious and clean appearance.

As illustrated in the drawings, the door part 31 and the drawer part 32 constituting the door 30 may be coupled to be separated from each other. Thus, assembling workability and serviceability may be improved through the separable structure of the door part 31 and the drawer part 32.

A rear surface of the door part 31 and a front surface of the drawer part 32 may be coupled to each other. When the door part 31 and the drawer part 32 are coupled to each other, power for the elevation of the elevation device 80 may be provided.

The driving device (see reference numeral 40 of FIG. 6) for elevating the elevation device 80 may be disposed on the door part 31, and the door part 31 and the drawer part 32 may be selectively connected to each other.

Particularly, the driving part (see reference numeral 40 of FIG. 6) provided in the door part 31 may be configured to receive power from the power source and to transmit the power to the elevation part 80. Thus, it may be possible to remove the door part 31 when the service of the driving part (see reference numeral 40 of FIG. 6) is necessary and to take measures simply by replacing only the door part 31.

The door part 31 and the drawer part 32 may be coupled by a pair of door frames 316 provided on both sides.

The door frame 316 may include a door coupling part 316*a* extending upward and downward to be coupled to the door part and a drawer coupling part 316*b* extending backward from a lower end of the door coupling portion 316*a*.

The door coupling part 316*a* may be coupled to the door part 31 by a separate coupling member and may be coupled to one side of the door part 31 by a simple coupling structure. Also, the drawer coupling part 316*b* may be disposed to be inserted into both sides of the drawer part 32 so as to be adjacent to the draw-out rail 33. Also, the drawer coupling part 316*b* may be mounted on the drawer part 32 in the state of being coupled to the draw-out rail 33.

The drawer coupling part 316*b* may be inserted into the drawer part 32 to support the drawer part 32 in a state in which the door coupling part 316*a* is coupled to the door part 31. Also, the drawer coupling part 316*b* may be coupled to the drawer part 32 by a separate coupling member or may be coupled by a structure that mutually match the drawer coupling part 316*b*.

Also, a drawer opening 35 through which a portion of the elevation device 80 is exposed may be defined in the front surface of the drawer part 32 so that the driving device 40 and the elevation device 80 are connected to each other when the door part 31 and the drawer part 32 are coupled to each other.

The door part 31 may be configured to substantially open and close the storage chamber of the cabinet 10 and to define the front surface of the refrigerator 1.

The door part 31 may have an outer appearance that is defined by an outer case 311 defining a front surface and a portion of a circumferential surface, a door liner 314 defining a rear surface, and an upper deco 312 and a lower deco 313 which respectively define top and bottom surfaces. Also, an insulation material 300 may be filled in the inside of the door part 31 between an outer case 311 and a door liner 314.

Hereinafter, the door part 31 constituting the door 30 and the driving device 40 provided in the door part 31 will be described in more detail with reference to the drawings.

Figure 5:
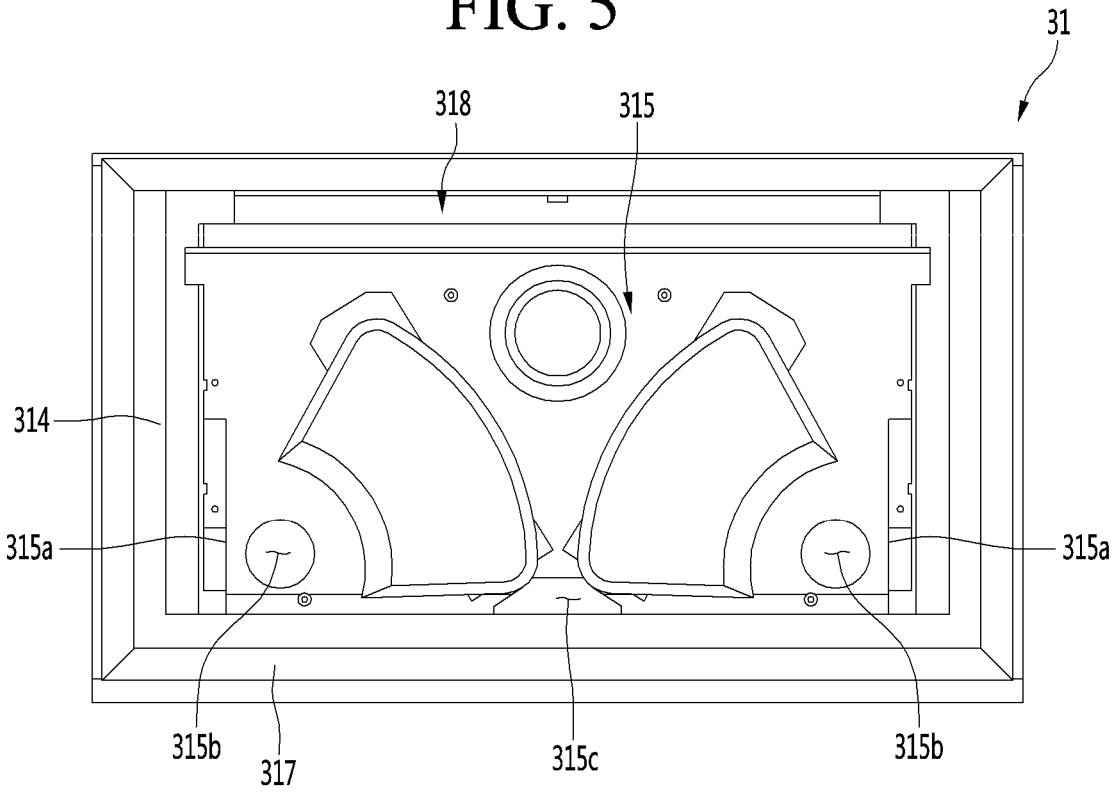
FIG. 5 is a rear view of the door part.
Figure 6:
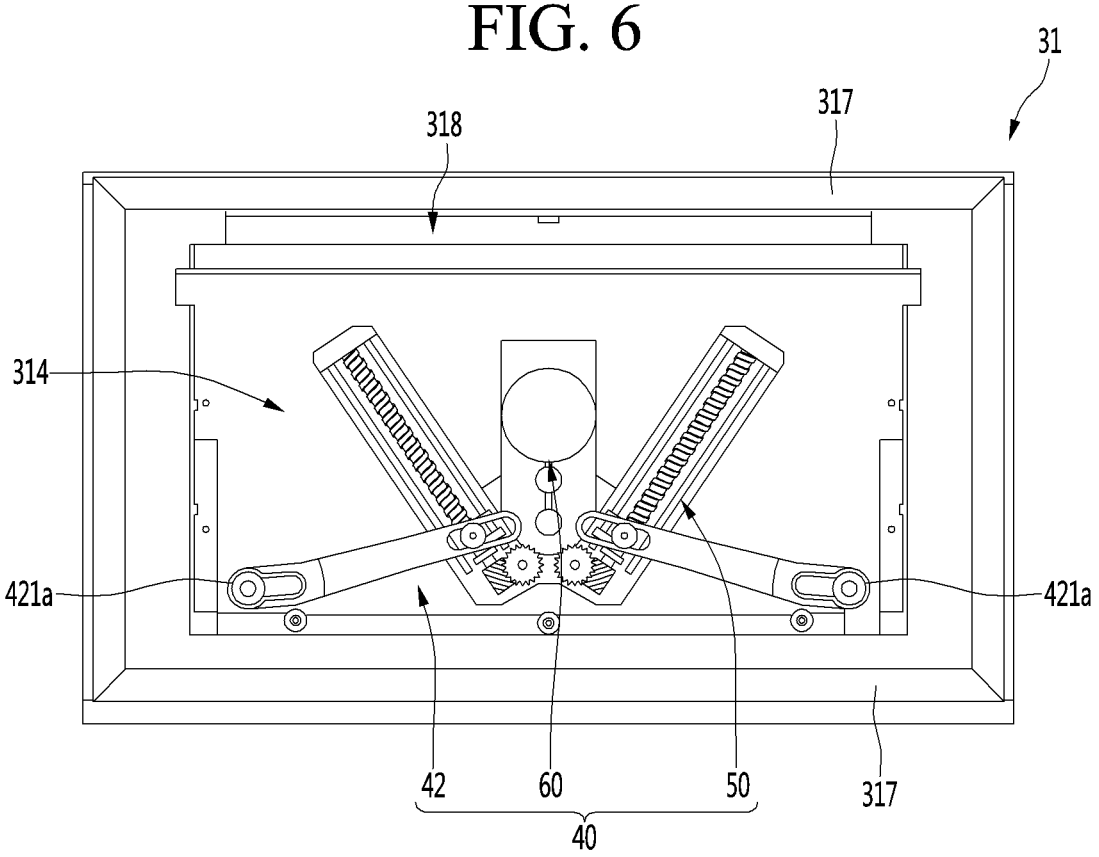
FIG. 6 is a rear view illustrating a state in which a door cover of the door part is removed.
Figure 7:
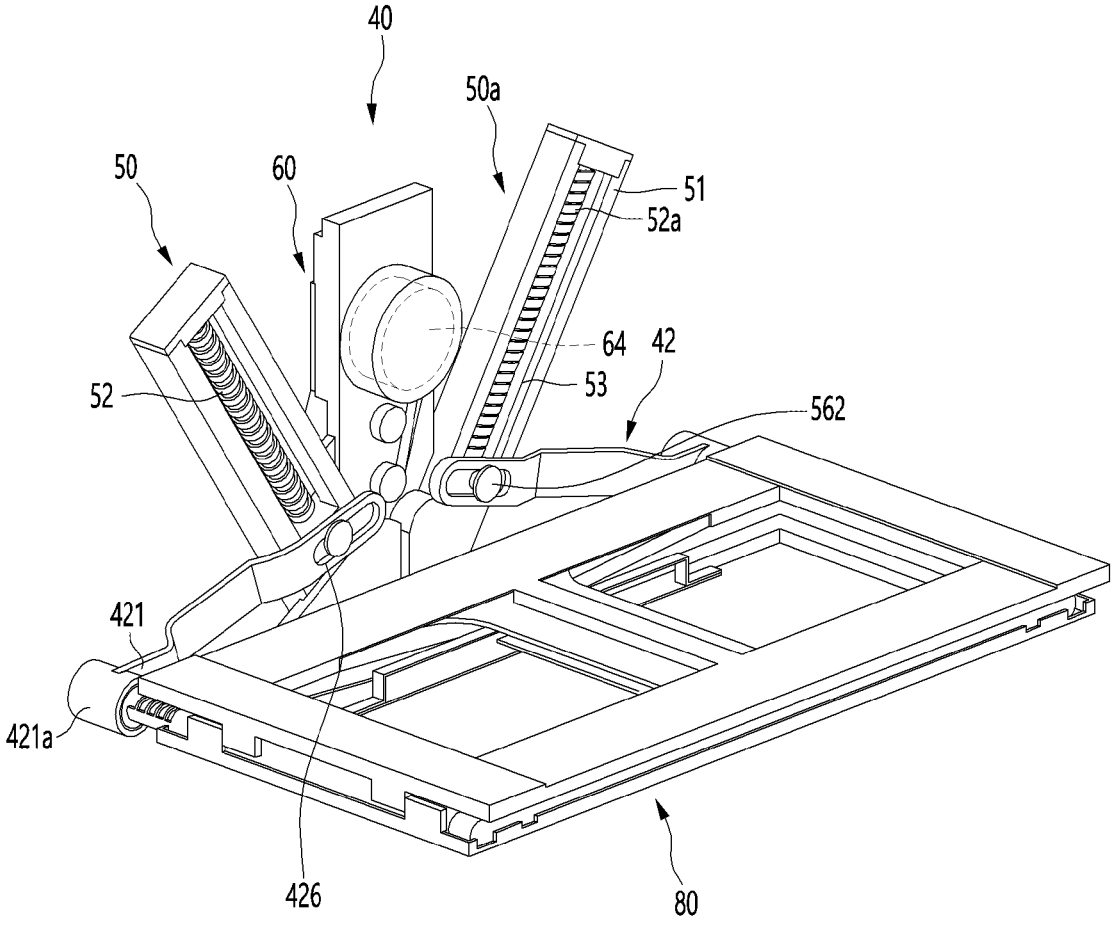
FIG. 7 is a perspective view illustrating a state in which a driving device and an elevation device are connected to each other when viewed from a front side of the driving device.
Figure 8:
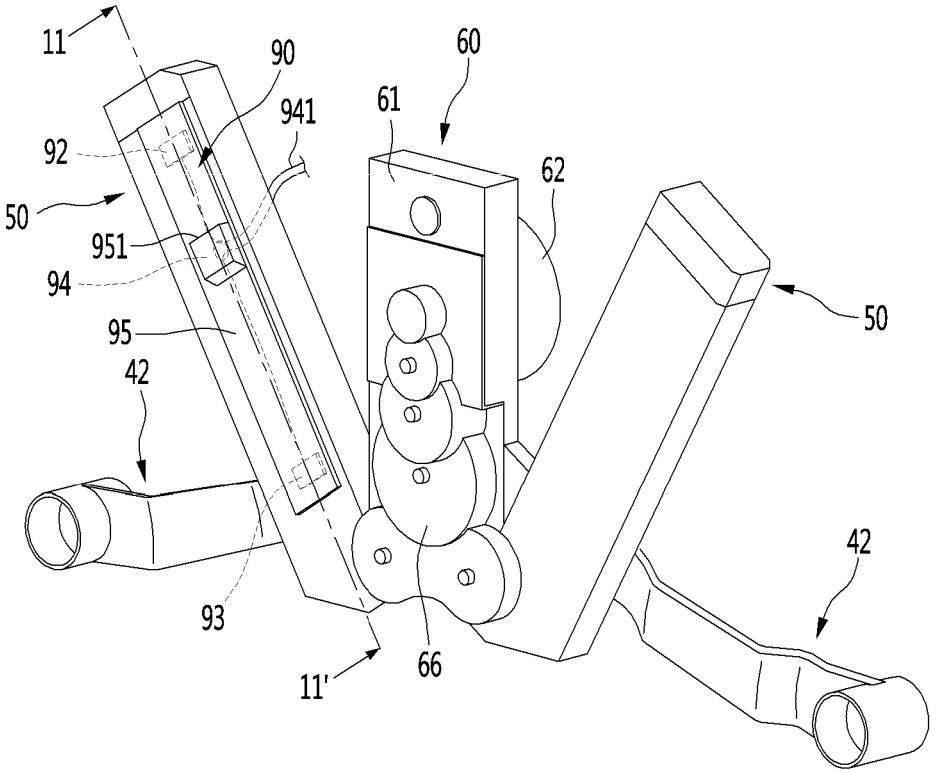
FIG. 8 is a rear perspective view of the driving device.
Figure 9:
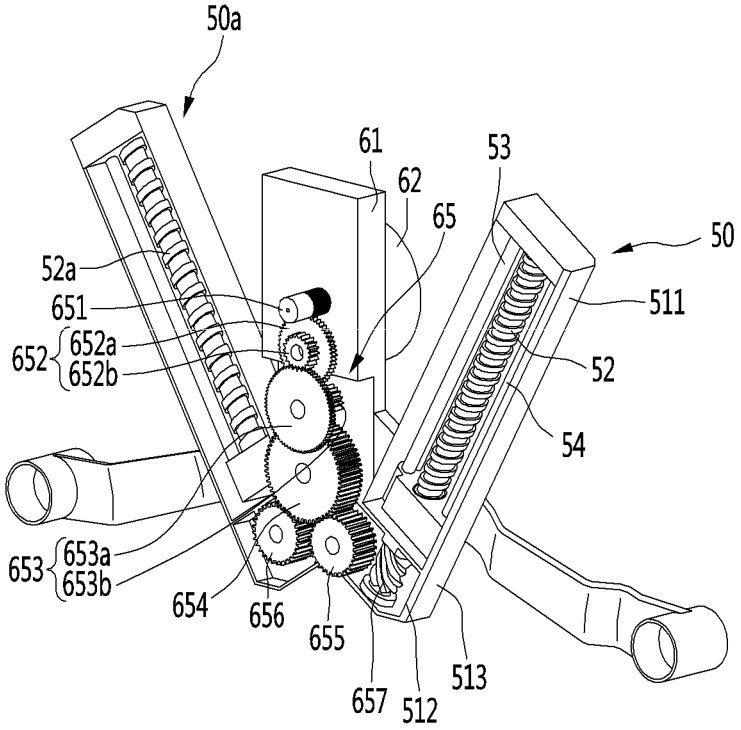
FIG. 9 is a rear perspective view illustrating an internal structure of the driving device.
Figure 10:
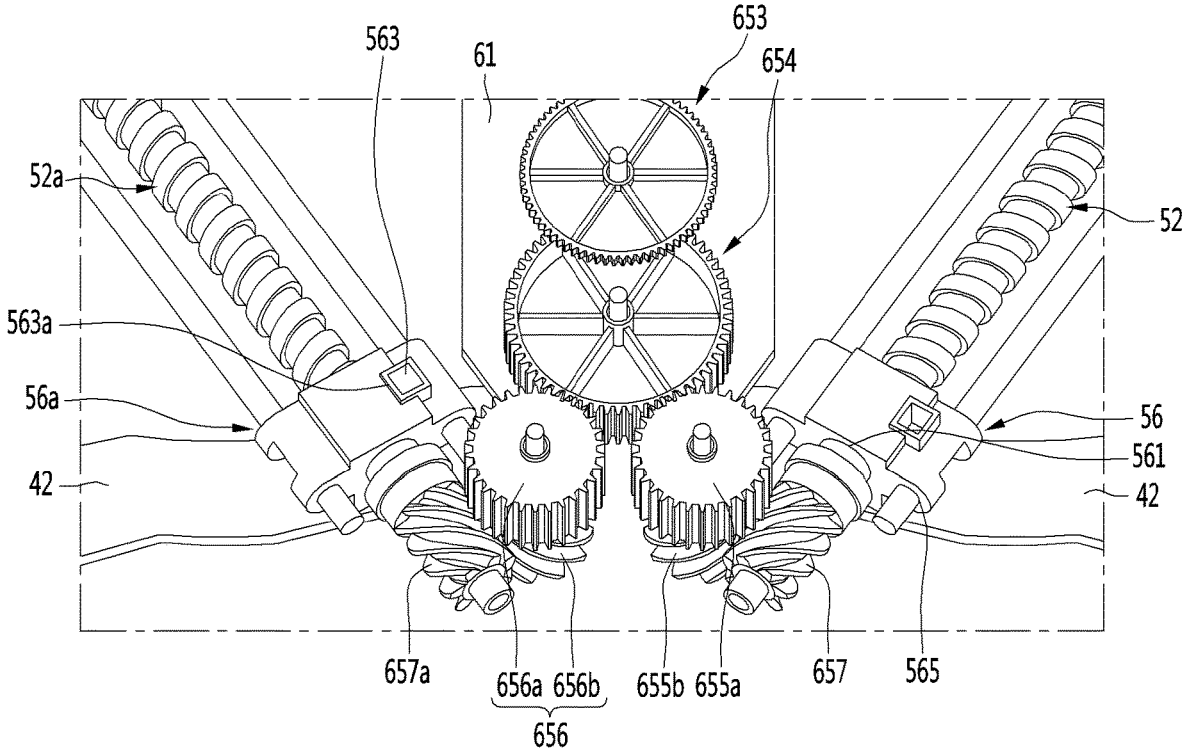
FIG. 10 is a partial enlarged view of a structure in which power is transmitted to a screw of the driving device.
Figure 11:
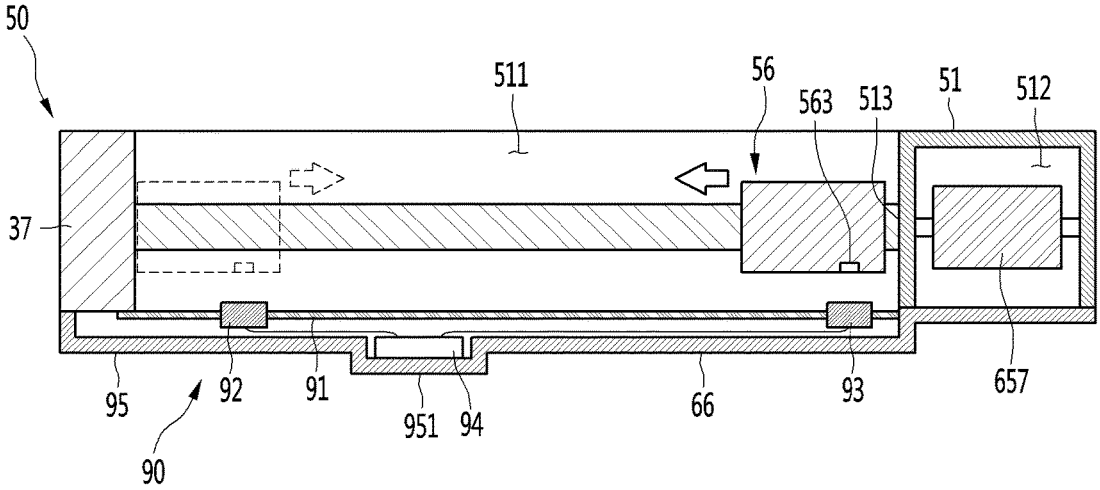
FIG. 11 is a cross-sectional view taken along line 11-11' of FIG. 8.

FIG. 5 is a rear view of the door part. Also, FIG. 6 is a rear view illustrating a state in which a door cover of the door part is removed. Also, FIG. 7 is a perspective view illustrating a state in which the driving device and the elevation device are connected to each other when viewed from a front side of the driving device. Also, FIG. 8 is a rear perspective view of the driving device. Also, FIG. 9 is a rear perspective view illustrating an internal structure of the driving device. Also, FIG. 10 is a partial enlarged view of a structure in which power is transmitted to a screw of the driving device. Also, FIG. 11 is a cross-sectional view taken along line 11-11' of FIG. 8.

Referring to FIGS. 4 to 11, a front surface of the door part 31 may be defined by the outer plate 311, and a rear surface may be defined by the door liner 314.

Also, a driving device 40 for operating the elevation device 80 may be provided inside the door part 31. Although the driving device 40 may be disposed inside the door part 31, the driving device 40 but is not embedded in the insulation material but is disposed inside the space defined by the door liner 314. Then, the driving device 40 may be covered by the door cover 315 and thus may not be exposed to the outside.

In detail, the insulating material may be filled between the outer plate 311 and the door liner 314 to insulate the inside of the storage chamber 12.

Also, the door liner 314 may have a door recess part that is recessed inward. The door recess part may be defined in a shape corresponding to the shape of the driving device 40 and may be recessed inside the door 30. Also, the door recess part may be recessed so that electric components including the lighting unit 318 for illuminating the inside of the refrigerator are further mounted.

The lighting unit 318 may be defined to be long in the lateral direction from the left side to the right side of the rear surface of the door 30 and may be disposed at the uppermost position of the inner side regions of a gaskets 317 disposed along the rear surface of the door 30.

The lighting unit 318 may be configured so that light emitted from the plurality of LEDs is emitted to the inside of the door 30, particularly, the inside of the drawer part 32. When the door 30 is withdrawn to be opened, the lighting unit 318 may illuminate the inside of the drawer part 32.

The door cover 315 may be configured to define an outer appearance of the rear surface of the door part 31 and may cover the driving device 40 mounted on the door part 31. The door cover 315 may have a plate shape to cover the driving device so that the door cover 315 is not exposed in the driving device 40 is mounted.

The door cover 315 may have the cover recess part at a corresponding position to cover the driving device 40 from the rear side. The cover recess part may be recessed from the front surface of the door cover 315, i.e., the driving device 40, and the rear surface of the door cover 315 may protrude toward the inside of the storage chamber.

Also, a side cutout part 315*a* may be defined in the left and right ends of the door cover 315. The side cutout part 315*a* may be a portion that exposes the supporter 319 to be coupled with the door frame 316 and may be defined inward in a shape corresponding to the supporter 319.

Also, a door opening 315*b* may be defined in each of both sides of a lower end of the door cover 315. An accommodation part 421*a* of the lever 42, which is one component of the driving device 40, may be exposed through the cover opening 315*b*. Thus, the user may be accessible to the accommodation part 421*a* through the cover opening 315*b*. Also, the cover opening 315*b* may be disposed to face the drawer opening 35.

Thus, when the door par 31 and the drawer part 32 are coupled to each other, the cover opening 315*b* and the drawer opening (see reference numeral 35 of FIG. 13) may communicate with each other. Thus, the accommodation part 421*a* and the coupling part 842*c* of the elevation device 80 may be coupled to each other through the cover opening 315*b* and the drawer opening 35. That is, the driving device 40 and the elevation device 80 may be connected to each other, and the elevation device 80 may be elevated according to an operation of the driving device 40. Also, only the elevation device 80 may be separated by separating the accommodation part 421*a* from the coupling part 842*c* in the state in which the door part 31 and the drawer part 32 are coupled to each other.

A cable hole 315*c* may be further defined in the lower end of the door cover 315 to allow the cable to be connected to the electric components such as the driving device 40 and the lighting unit 318, which are provided in the door part 31. The electric wire that is accessible through the cable hole 315*c* may be connected to the cabinet 10 via the lower side of the drawer part 32.

The door gasket 317 may be provided along the rear surface of the door part 31. When the door 30 is closed, the door gasket 317 may airtightly contact the front surface of the cabinet 10 in the state in which the door 30 is closed.

The driving part 40 may be disposed inside the door part 31 by being covered by the door cover 315. The power of the driving device 40 may be transmitted to the elevation device 80. Here, the power may be transmitted to both sides of the elevation device 80 so that the elevation device 80 ascends and descends in the horizontal state at both left and right sides without being tilted or biased to one side under any situation.

Hereinafter, a structure of the driving device 40 will be described in detail.

The driving device 40 may include a motor assembly 60, a pair of screw units, or screw assemblies, 50 and 50*a* disposed on both sides of the motor assembly 60, and a pair of levers 42 respectively connected to the pair of screw units 50 and 50*a*.

In detail, the motor assembly 60 may be disposed at a central portion in left and right direction of the door part 31. Also, the driving device 40 may allow both the screw units 50 and 50*a* and the lever 42 to operate by the motor assembly including one driving motor 64.

Particularly, the motor assembly 60 may adjust decelerating and magnitude of the transmitting force through a combination of a plurality of gears.

Also, the motor assembly 60 may have a structure in which the driving motor 64 and the gears are arranged vertically to minimize a space recessed when the motor assembly 60 is mounted on the door part 31, in particular, a width in the left and right direction is widened, and a thickness in the front and rear direction is minimized.

Also, the driving motor 64 constituting the motor assembly 60 may protrude toward the drawer part 32 to minimize a depth of the door part 31 to secure insulation performance.

The driving motor 64 may provide power for elevating the elevation device 80 and may rotate forwardly and reversely. Thus, when an elevation signal of the elevation device 80 is inputted, the elevation device 80 may rotate forwardly and reversely to provide the power for elevating the elevation device 80. Also, an input of a stop signal due to the load of the driving motor 64 or the detection of the sensor may be stopped.

The motor assembly may include a motor case 61 in which the driving motor 64 is installed and a motor cover 62 coupled to the motor case 61 to cover the driving motor 64.

A rotation shaft of the driving motor 64 may protrude from the motor case 61 in a direction opposite to the motor cover 62. Also, the motor assembly may further include a power transmission part that transmits power of the driving motor 64. The power transmission part may be disposed at an opposite side of the driving motor 64 with respect to the motor case 61.

Also, the power transmission part may be constituted by a combination of a plurality of gears and be covered by the cover member 68 mounted on the opposite side of the driving motor 64.

The power transmission part may include a driving gear 651 connected to the shaft of the driving motor 64 passing through the motor case 61. The power transmission part may further include a first transmission gear 652 engaged with the driving gear 651 at a lower portion of the driving gear 651.

For example, the first transmission gear 652 may be a multi-stage gear. For example, the first transmission gear 652 may include a first gear 652*a* engaged with the drive gear 651 and a second gear 652*b* having a diameter less than that of the first gear 652*a*. Each of the first gear 652*a* and the second gear 652*b* may be a spur gear.

The power transmission part may further include a second transmission gear 653 engaged with the first transmission gear 652. The second transmission gear 653 may be engaged with the first transmission gear 652 at the lower portion of the first transmission gear 652. The second transmission gear 653 may include a first gear 653*a* engaged with the second gear 652*a* of the first transmission gear 652 and a second gear 653*b* having a diameter greater than that of the first gear 653*a*.

Each of the first gear 653*a* and the second gear 653*b* of the second transmission gear 653 may be a spur gear. Also, the second gear 653*b* of the second transmission gear 653 may be disposed below the first gear 652*a* of the first transmission gear 652. Thus, a longitudinal width of the driving part 40 may be prevented from increasing by the first transmission gear 652 and the second transmission gear 653.

The power transmission part may further include a third transmission gear 654 engaged with the second transmission gear 653. The third transmission gear 654 may be engaged with the second gear 653*b* at a lower portion of the second gear 653*b* of the second transmission gear 653. The third transmission gear 654 may be a spur gear. A portion of the third transmission gear 654 may be arranged to overlap the second transmission gear 653 in the longitudinal direction.

The motor case 61 may be provided with a gear shaft for rotatably supporting the plurality of transmission gears.

The power transmission part may include a pair of intersection gears 655 and 656 that engage with the third transmission gear 654. The pair of intersection gears 655 and 656 are disposed to be spaced apart from each other in the horizontal direction and may be engaged with the third transmission gear 654 at a position lower than the center of rotation of the third transmission gear 654.

Each of the intersection gears 655 and 656 may include spur gear parts 655*a* and 656*a*, each of which has the form of a spur gear, and first helical gear parts 656*b* and 656*b*, each of which has the form of a helical gear so that each of the intersection gears 655 and 656 is engaged with the third transmission gear 654.

Also, rotation center lines of the intersection gears 655 and 656 spaced from each other on both left and right sides may extend horizontally to each other.

The power transmission unit may further include a pair of second helical gear parts 657 and 657*a* that are respectively engaged with the intersection gears 655 and 656.

The second helical gear parts 657 and 657*a* may be engaged with the first helical gear parts 655*b* and 656*b*. The rotation center lines of the second helical gear parts 657 and 657*a* may be arranged to cross the rotation center lines of the intersection gears 655 and 656. Thus, the first and second helical gear parts 655*b* and 656*b* and the second helical gear parts 657 and 657*a* may be coupled to each other in the crossing state to transmit rotation force with respect to each other.

The rotation center lines of the intersection gears 655 and 656 may extend in the longitudinal direction, and the rotation center lines of the second helical gear parts 657 and 657*a* may extend in the vertical direction. The rotation center lines of the second helical gear parts 657 and 657*a* disposed on both the left and right sides may be inclined in a direction that is away from each other upward.

The use of the pair of intersection helical gears may facilitate switching of the power transmission direction to realize a compact structure for the power transmission. Particularly, even when large force is transmitted for the elevation of the elevation device 80, large noise may not be generated.

The pair of screw units 50 and 50*a* may be disposed on both the left and right sides of the motor assembly 60.

The pair of screw units 50 and 50*a* may be disposed on both the left and right sides of the inside of the door unit 31. The pair of screw units 50 and 50*a* may have the same structure and shape as each other except for their mounting positions.

The power of the drive motor 64 may be transmitted from the lower portions of the screw unit 50 and 50*a*.

Here, the screw units 50 on both sides may be symmetrical to each other with respect to the motor assembly 60. Thus, the motor assembly 60 may be disposed between the screw units 50 disposed on both the sides. The screw units 50 disposed on both the sides may be gradually close to each other from upper ends to lower ends.

The screw units 50 and 50*a* may include screws 52 and 52*a* that rotate by receiving the power of the driving motor 64. The screws 52 and 52*a* may extend in the vertical direction. Here, the upper end of each of the screws 52 and 52*a* may be inclined toward the outer side, and the lower end may be inclined toward the inner side.

The screws 52 and 52*a* may be connected to the second helical gear parts 657 and 657*a*. The screws 52 and 52*a* may rotate together when the second helical gear parts 657 and 657*a* rotate.

For example, an insertion part may be defined in each of the second helical gear parts 657, 657*a*, and an accommodation groove into which the insertion part is accommodated may be defined in the screw 52.

Thus, the screws 52 and 52*a* may also be disposed symmetrically on both sides of the motor assembly 60 and may be inclined in the same center line as the center line of the second helical gear parts 657 and 657*a*. Thus, the screws 52 and 52*a* on the left and right sides may be arranged in a direction that is away from each other toward the upper side.

The screw units 50 and 50*a* may further include screw holders 56 and 56*a* coupled to the screws 52 and 52*a* so as to pass therethrough.

The screw holders 56 and 56*a* may move vertically along the screws 52 and 52*a* when the screws 52 and 52*a* rotate. The lever 42 may be coupled to the screw holders 56 and 56*a*. The lever 42 may rotate when the screw holders 56 and 56*a* move.

A holder through-hole 561 may be defined in a center of each of the screw holders 56 and 56*a*. The holder through-hole 561 may be defined to pass through the screw holders 56 and 56*a*, and the screws 52 and 52*a* may be inserted and mounted to pass through the holder through-hole 561. A screw thread coupled to the screw may be disposed on an inner surface of the holder through-hole 561. When the screws 52 and 52*a* rotate, the screw holders 56 and 56*a* may be movable along the screws 52 and 52*a*.

A guide hole 565 may be defined in both left and right sides of the holder through-hole 561. The guide hole 565 may receive the guide bars 53 and 54, which will be described below, and the screw holders 56 and 56*a* may move along the guide bars 53 and 54. Here, a bearing or another constituent for reducing friction may be disposed on the inner surface of the guide hole 565 to facilitate the movement of the screw holders 56 and 56*a*.

The pair of guide bars 53 and 54 may be configured to pass through the guide holes 565. Thus, the screw holders 56 and 56*a* may be stably elevated without moving horizontally. The elevation device 80 may be stably elevated even under a heavy load, and the noises may not be generated.

Also, the screw holder 56*a* may be provided with a magnet 563. For example, the screw holder 56*a* may have a magnet mounting groove 563*a* into which the magnet is press-fitted and may have a structure in which the magnet 563 is inserted into the magnet mounting groove 563*a*.

The magnet 563 may detect a position of the screw holder 56*a*. When the screw holder 56*a* is disposed at the lowermost or uppermost end of each of the screws 52 and 52*a*, an elevation detection device 90 described below may detect the screw holder 56*a*. That is, whether the ascending or descending of the elevation device is completed may be determined by detecting the magnet 563 mounted on the screw holder 56*a*.

Also, a structure in which a holder connector 562 is capable of being mounted may be provided on an opposite side of the rear surface of the screw holder 56*a* in which the magnet 563 is provided, i.e., on the front surface of the screw holder 56*a*.

The holder connector 562 may connect the lever 42 to the screw holders 56 and 56*a* and may be fixedly mounted on the screw holders 56 and 56*a*. That is, the holder connector 562 may be coupled to the screw holders 56 and 56*a* while passing through the lever 42. The lever 42 may include a rectangular slot 426 to prevent an interference with the holder connector 562 during the rotation of the lever 42.

Since the screw units 50 and 50*a* are disposed on both the left and right sides, extension lines of the screws 52 and 52*a* on both the left and right sides may cross each other outside the driving device 40.

The lever 42 may connect the screw holder 56 and 56*a* to the elevation device 80. Thus, both ends of the lever 42 may be rotatably coupled to the screw holder 56 and 56*a* and the elevation device 70, respectively.

The screw units 50 and 50*a* may further include a housing 51 for accommodating the screws 52 and 52*a*.

The housing 51 may define an outer appearance of the screw unit 50 and provide a space in which the screws 52 and 52*a* and the screw holder 56 and 56*a* are accommodated. The opened portion of the housing 51 may be covered by the cover member 66.

The housing 51 may be made of a metal material to be bent or made of a plastic material.

The housing 51 may include a first accommodation part 511 accommodating the screws 52 and 52*a* and a second accommodation part 512 accommodating the second helical gear parts 657 and 657*a*.

The first accommodation part 511 and the second accommodation part 512 may be partitioned by the partition wall 513. The second accommodation part 512 may be disposed below the first accommodation part 511.

A portion of the intersection gears 655 and 656 may be accommodated in the second accommodation part 512. That is, the intersection gears 655 and 656 and the second helical gear parts 657 and 657*a* may be connected to each other in the second accommodation part 512.

A lower portion of each of the screws 52 and 52*a* may pass through the partition wall 513, and the second helical gear parts 657 and 657*a* may be coupled to the screws 52 and 52*a* passing through the partition wall 513.

The housing 51 may be provided with one or more guide bars 53 and 54 guiding the ascending of the screw holders 56 and 56*a*. The one or more guide bars 53 and 54 extend in parallel with the screws 52 and 52*a* while being spaced apart from the screws 52 and 52*a*.

The plurality of guide bars 53 and 54 may be provided in the housing 51 so that the screw holders 56 and 56*a* are not inclined to any one side of the left or right sides with respect to the screws 52 and 52*a*. Here, the screw 52 may be disposed between the plurality of guide bars 53 and 54.

The motor case 61 and the pair of housings 51 may be integrated with each other. A single cover member 66 may cover the motor case 61 and the pair of housings 51.

That is, the cover member 66 may be coupled to the motor case 61 to cover the power transmission part and be coupled to the pair of housings 51 to cover the screws 52 and 52*a*, the guide bars 53, and the screw holders 56 and 56*a*.

Alternatively, as necessary, the cover member 66 may include a plurality of portions that cover the power transmission part and the screw units 50 and 50*a*, respectively, and may be configured to independently open and close the respective parts.

Since the driving device 40 is in the form of a single module, the driving part 40 may be compact and be easily installed in the door part 31.

The single cover member 66 may cover the motor case 61 and the pair of housings 51 together. Thus, when the cover member 66 is separated, the user may easily accessible to the motor case 61 and the pair of housings 51.

The screw unit 50*a* disposed at one side of the left and right screw units 50 and 50*a* may be provided with the elevation detection device 90. Since the screw units 50*a* on both the left and right sides operate simultaneously by the one motor assembly 60, the operation of the elevation device 80 may be effectively performed even if the elevation detection device 90 is provided in only one screw unit 50*a*. Thus, the elevation detection device 90 may be provided on either one of the left and right screw units 50 and 50*a*.

The elevation detection device 90 may be configured to determine whether the elevation of the elevation device 80 is completed. Here, it may be determined whether the elevation device 80 is completely elevated based on the operation of the driving device 40.

The elevation detection device 90 may be mounted on the cover member 66 and vertically disposed along the screw unit 50*a*.

The elevation detection device 90 may include a support plate 91, detection sensors 92 and 93 mounted on the support plate 91, and a case 95 accommodating the support plate 91.

In detail, the support plate 91 may have a length greater than that of at least the screw 52*a* or stroke of the screw holder 56*a*. The support plate 91 may be disposed on a first area 511 on which the screw holder 56*a* moves and may be disposed along a path along which the magnet 563 moves. Both ends of the support plate 91 may be fixedly mounted on the partition wall 513 and caps 57 of the upper ends of the screw units 50 and 50*a*.

The support plate 91 may have a plate shape, and a pair of detection sensors 92 and 93 may be mounted on both sides of the support plate 91. The support plate 91 may be made of a plate-like material that is fixedly mounted on detection positions of the detection sensors 92 and 93. Also, the support plate 91 may be a substrate on which the detection sensors 92 and 93 are mounted.

A sensor for detecting the magnet 563 may be used as each of the detection sensors 92 and 93. The detection sensor may be a hall sensor that normally detects the position of the magnet. Alternatively, as necessary, other sensors or devices for detecting the magnet 563 may be provided instead of the hall sensor.

Also, other configurations or devices that are capable of detecting a specific position of the screw holder 56*a* may be used instead of the magnet 563 and the hall sensor.

One of the detection sensors 92 and 93 may mounted at a position corresponding to the position of the magnet 563 when the elevation device 80 completely ascends, and another one may be mounted at a position corresponding to the position of the magnet 563 when the elevation device 80 completely descends. Thus, when any one detection sensor 92 or 93 of the pair of detection sensors 92 and 93 recognizes the magnet, it is determined that the elevation device 80 completely ascends or descends.

The support plate 91 on which the detection sensors 92 and 93 are mounted may be accommodated in the case 95. The case 95 may be a portion of the cover member 66. The case 95 may be recessed from the inner surface of the cover member 66 and provide a space in which the support plate 91 is accommodated. The case 95 may be separately provided and mounted on the cover member 66.

The case 95 may define a space for accommodating the support plate 91. The case 95 may further include a connector mounting part 951 provided with a connector 94. The connector mounting part 951 may protrude to accommodate the connector 94 therein.

The connector 94 may be connected to an electric wire extending from the pair of the detection sensors 92 and 93 and be connected to an electric wire 941 from the outside. That is, it may be possible to connect the electric wire to the connector 94 from the outside without separating the support plate 91 or the detection sensors 92 and 93.

When the support plate 91 is the substrate on which the detection sensors 92 and 93 are mounted, the connector 94 may be disposed on the support plate 91 corresponding to the connector mounting part 951.

Figure 12:
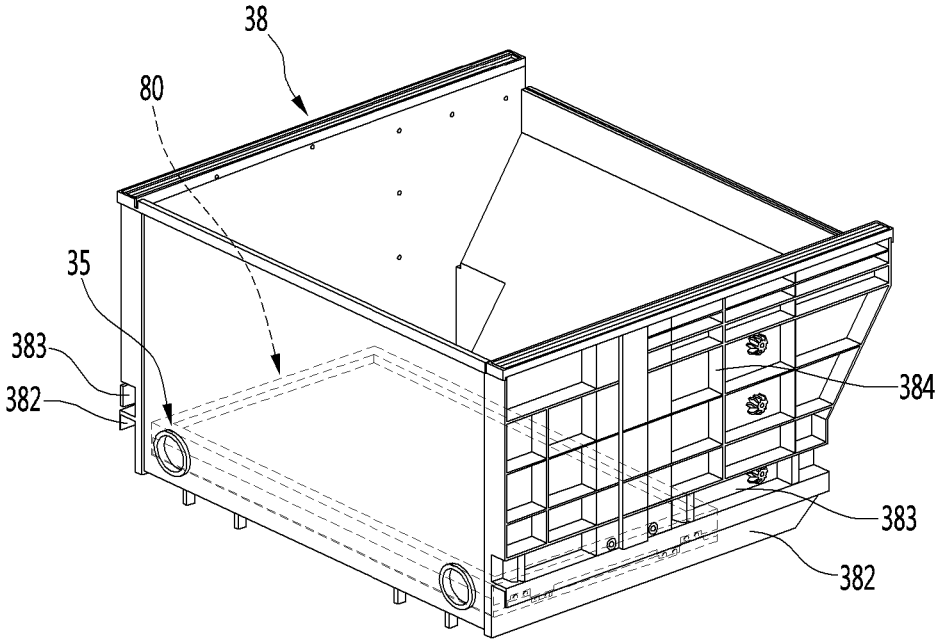
FIG. 12 is a perspective view of the drawer part.

FIG. 12 is a perspective view of the drawer part. Also, FIG. 13 is an exploded perspective view of the drawer part.

Figure 13:
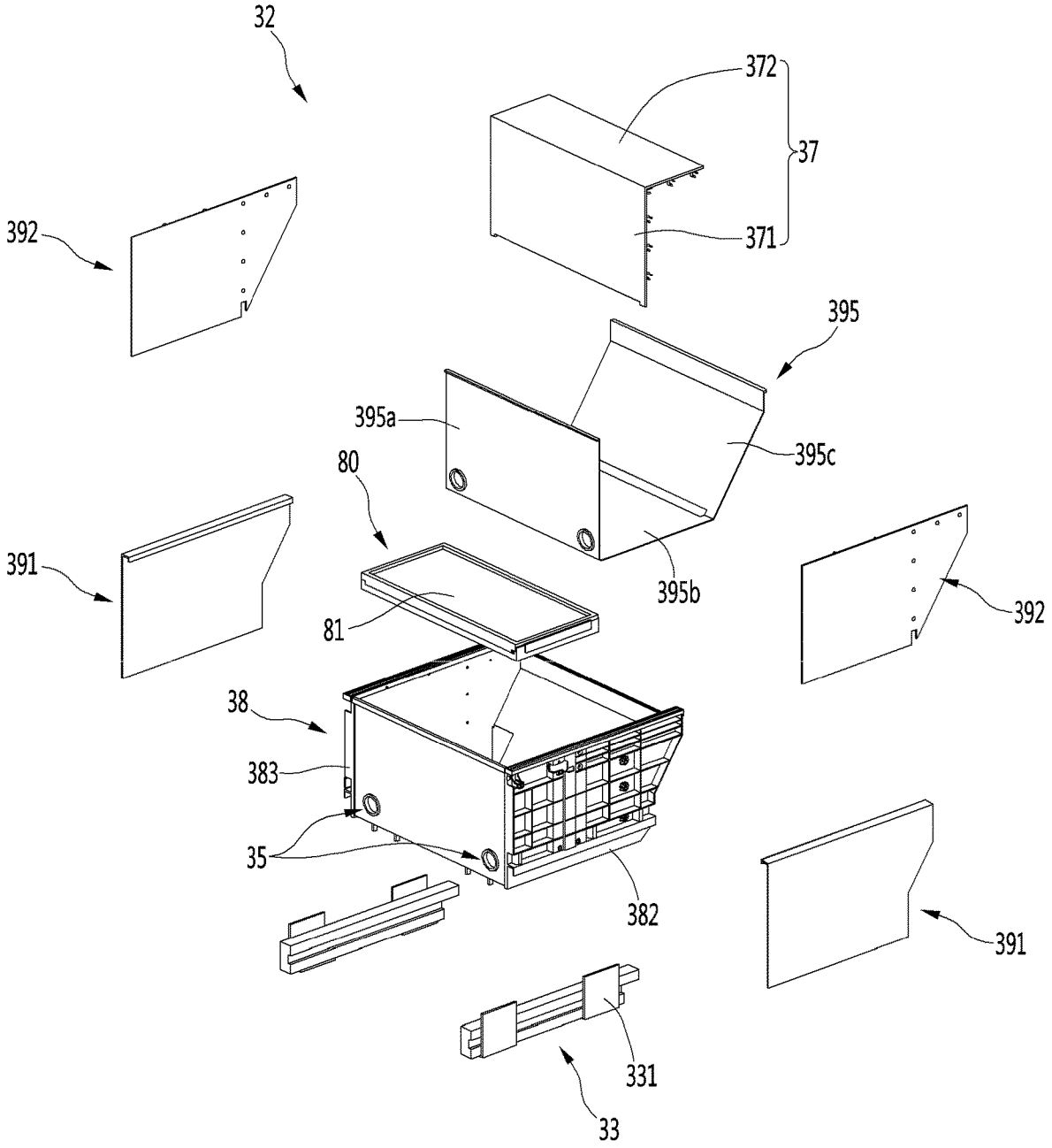
FIG. 13 is an exploded perspective view of the drawer part.

Referring to FIGS. 3, 13, and 13, the drawer part 32 may include a drawer body 38 defining an entire shape of the drawer part 32, an elevation device 80 provided in the drawer body 38 to elevate the container and food, and a plurality of plates 391, 392, and 393 defining an outer appearance of the drawer part 32.

In detail, the drawer body 38 may be injection-molded by using a plastic material and define an entire shape of the drawer part 32. The drawer body 38 may have a basket shape having an opened top surface to define a food storage chamber therein. An inclined surface 321 may be disposed on a rear surface of the drawer body 38. Thus, an interference with the machine room 3 may not occur.

The door frames 316 may be mounted on both sides of the drawer part 32. The door frame 316 may be coupled to the lower frame of each of both sides of the bottom surface or both left and right surfaces of the drawer part 32. In the state in which the door frame 316 and the drawer part 32 are coupled to each other, the drawer part 32 and the door part 31 may be integrally coupled to be inserted and withdrawn.

The door frame 316 and the drawer part 32 may be coupled to each other by a separate coupling member or a coupling structure between the door frame 316 and the drawer unit 32.

The draw-out rack 34 may be disposed on each of both the sides of the bottom surface of the drawer part 32. The drawer part 32 may be inserted and withdrawn forward and backward by the draw-out rack 34. In detail, in the state in which the drawer part 32 is mounted on the cabinet 10, at least a portion is disposed in the storage chamber. Also, the draw-out rack 34 may be coupled to a pinion gear 141 disposed on the bottom surface of the storage chamber. Thus, when the draw-out motor 14 is driven, the pinion gear 141 may rotate to allow the draw-out rack 34 to move, and the door 30 may be inserted and withdrawn.

The door 30 may not be automatically inserted and withdrawn. That is, the user may push or pull the door 30 to be inserted and withdrawn. Here, the draw-out rack 34 may be omitted, and thus, the insertion and withdrawal may be performed through only the draw-out rail 33.

A rail mounting part 382 on which the draw-out rail 33 for guiding the insertion and withdrawal of the drawer body 38 is mounted may be disposed on a lower portion of each of both the side surfaces of the drawer body 38. The rail mounting part 382 may extend from a front end to a rear end and provide a space in which the draw-out rail 33 is accommodated.

The draw-out rail 33 may be a rail that extends in multistage. The draw-out rail 33 may have one end fixed to the storage chamber inside the cabinet 10 and the other end fixed to the rail mounting part 382 to more stably realize insertion and the withdrawal of the door 30.

Also, the plurality of plates 391, 392, and 393 made of a plate-shaped metal material such as stainless steel to define at least portions of the inside and outside of the drawer body 38 may be provided on the drawer body 38.

In detail, the outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, the constituents such as the door frame 316 and the draw-out rail 33, which are mounted on both the sides of the drawer body 38 may not be exposed to the outside.

A plurality of reinforcement ribs 384 may cross each other in vertical and horizontal directions on both outer surfaces of the drawer body 38. The reinforcement ribs 384 may reinforce the strength of the drawer body 38 itself so that the drawer body 38 is more rigidly shaped relative to the weight of the door, which increases by providing the driving device 40 and the elevation device 80.

Also, the reinforcement ribs 384 may support the outer side plates 391 mounted on both side surfaces, and thus the outer appearance of the drawer part 32 may be firmly maintained.

An inner side plate 392 may be disposed on each of both left and right surfaces of the inside of the drawer body 38. The inner side plate 392 may be mounted on each of both the side surfaces of the drawer body 38 to define both the left and right surfaces of the inside thereof.

The inner plate 395 may be constituted by a front surface part 395*a*, a bottom surface part 395*b*, and a rear surface part 395*c*, which have sizes correspond to the front surface, the bottom surface, and the rear surface of the inside of the drawer body 38.

The inner plate 395 may be provided by bending the plate-shaped stainless material so that the inner plate 395 defines the inner surface of the remaining portion except for both the left and right surfaces of the drawer body 38. Also, both left and right ends of the inner plate 395 may contact the inner side plate 392. The front surface part 395*a*, the bottom surface part 395*b*, and the rear surface part 395*c* constituting the inner plate 395 may be separately provided and then coupled to or contact each other.

The entire inner surfaces of the drawer body 38 may be defined by the inner side plate 392 and the inner plate 395, and the inner surface of the drawer body 38 may provide texture of the metal.

Thus, the storage chamber within the drawer part 32 may have a metal texture on the whole, and the foods accommodated in the drawer part 32 may be more uniformly cooled and thus stored at a low temperature in the more uniform region. In addition, visually excellent cooling performance and storage performance may be provided to the user.

The drawer cover 37 may include a cover front part 371 that partitions the inside of the drawer body 38 into a front space S1 and a rear space S2 and a cover top surface part 372 bent from an upper end of the cover front surface part 371 to cover a top surface of the rear space S2.

That is, when the drawer cover 37 is mounted, only the front space S1, in which the elevation device 80 is disposed, may be exposed in the drawer body 38, and the rear space S2 may be covered by the drawer cover 37.

The elevation 80 may be disposed in the drawer body 38. The elevation device 80 may be connected to the driving device 40 and may be vertically movable. The left and right sides of the elevation device 80 may be elevated uniformly.

A drawer opening 35 may be defined in the lower part of the front surface of the drawer part 32 for coupling the elevation device 80 to the driving device 40.

The elevation device 80 may be provided as a scissors type so that the elevation device is folded in a descending state and unfolded in an ascending state. Thus, the container or food seated on the upper surface may be elevated.

Also, the elevation device 80 may be provided with a support plate 81, and the support plate 81 may provide a seating surface on which the container 36 or food is seated.

The height of the drawer opening 35 may be lower than the upper end of the elevation device 80, i.e., the upper surface of the support plate 81. Thus, the drawer opening 35 may be prevented from being seen from the inside of the drawer part 32 in any state in the state in which the elevation device 80 is mounted.

In addition, the support plate 81 may have a size and a shape corresponding to the front space to prevent foreign matters from being introduced into the elevation device 80 provided below the front space S1, and also, to fundamentally prevent safety accidents from occurring by blocking the access to the elevation device 80.

Figure 14:
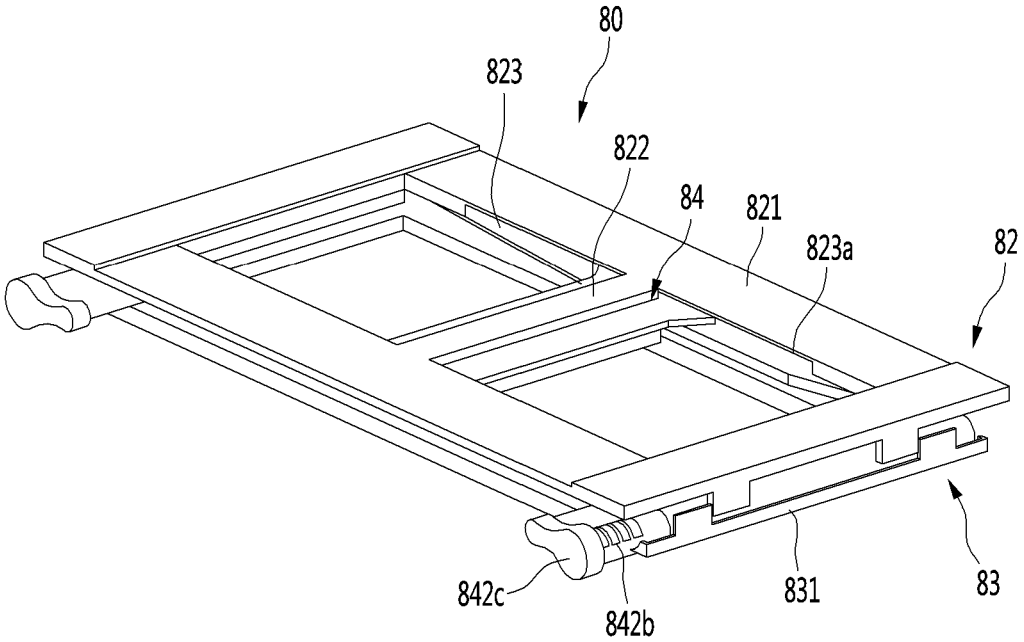
FIG. 14 is a perspective view of the elevation device according to an implementation.
Figure 15:
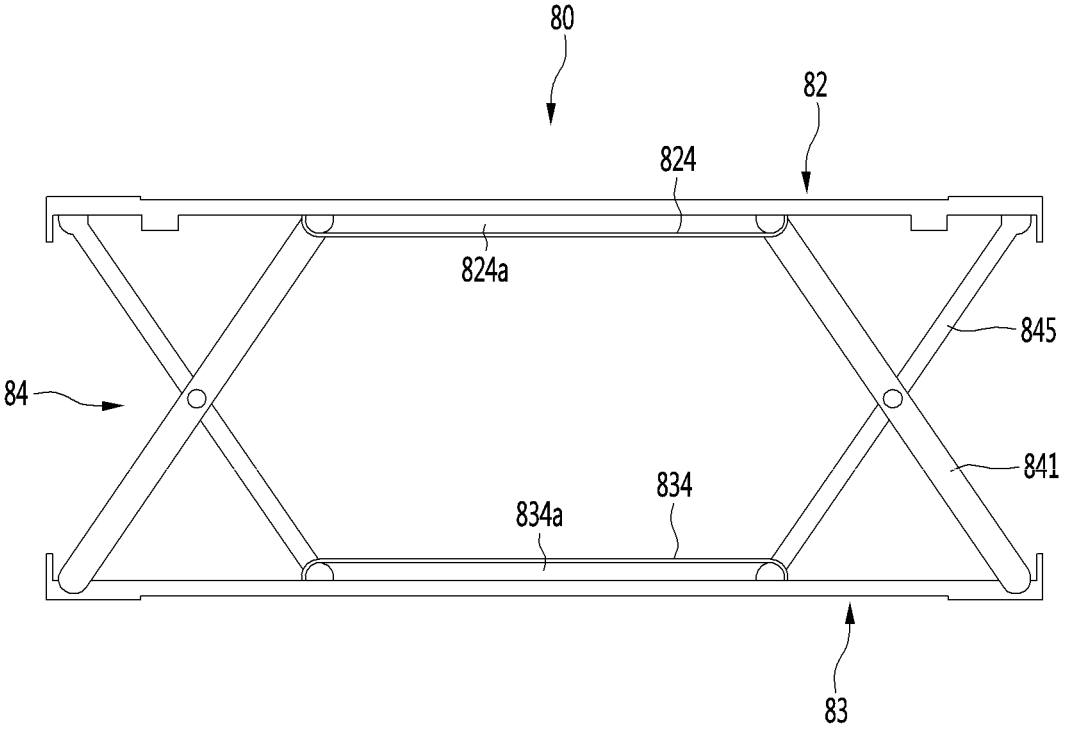
FIG. 15 is a view illustrating a state in which an upper frame of the elevation device ascends.

FIG. 14 is a perspective view of the elevation device according to an implementation. Also, FIG. 15 is a view illustrating a state in which an upper frame of the elevation device ascends. Also, FIG. 16 is a view illustrating a state in which the lever is connected to the elevation device.

Figure 16:
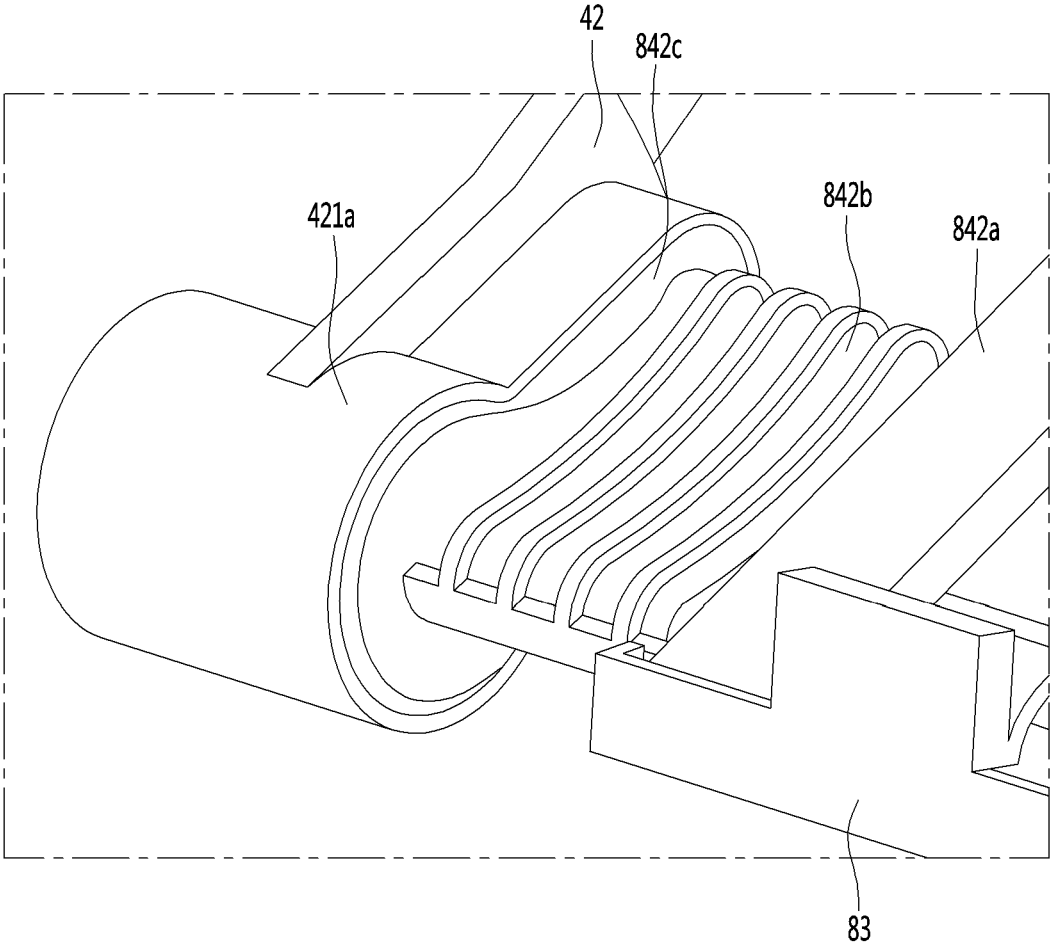
FIG. 16 is a view illustrating a state in which a lever is connected to the elevation device.

Referring to FIGS. 14 to 16, the elevation device 80 may be provided on the bottom surface of the inner side of the drawer part 32 and may be detachably installed on the inside of the drawer part 32.

Also, the elevation device 80 may include an upper frame 82, a lower frame 83, and a scissors assembly 84 disposed between the upper frame 82 and the lower frame 83.

In detail, the upper frame 82 may have a square frame shape corresponding to the size of the inner front space S1 of the drawer part 32 and to mount the support plate 81 on the top surface thereof.

The upper frame 82 of the elevation device 80 may move upward and downward and substantially supports food or the container 36 together with the support plate 81.

The upper frame 82 may generally defines a frame part 821 which defines a circumferential shape of the upper frame 82 and a partition part 822 for partitioning the space inside the frame portion 821 into left and right sides.

Since the frame part 821 and the partition part 822 define an outer frame and support the support plate 81, high strength may be required, and thus, the frame part 821 and the partition part 822 may be made of a metal and may have shape in which both ends are bent to increase the strength and prevent deformation.

Also, a slide guide 824 may be disposed on a bottom surface of the frame part 821 to accommodate the end of the scissors assembly 84 and guide the movement of the scissors assembly 84.

The scissors assemblies 84 may be disposed in both the spaces 823 and 823*a* of the partition 822, respectively.

The slide guide 824 may define a long hole 824*a* through which the scissors assembly 84 pass. The scissors assembly 84 may move along the slide guide 824.

The lower frame 83 may have the same or similar structure as the upper frame 82 except for a direction.

The lower frame 83 may include a frame part and a partition part. Also, the slide guide 834 which guides movement of the scissors assembly 84 by accommodating an end of the scissors assembly 84 may be disposed on a top surface of the lower frame 83.

The slide guide 834 may define a long hole 834*a* through which the scissors assembly 84 pass. The scissors assembly 84 may move along the slide guide 834.

The scissors assemblies 84 may be provided on both right and left sides. The scissors assemblies 84 on both sides may receive power from one driving motors 64 to operate and thus may be elevated at the same height.

Thus, the scissors assembly 84 may be effectively elevated by the pair of the scissors assemblies 84 which independently apply the forces to both sides even when the heavy load is supported by the scissors assembly 84. Here, the upper frame 82, i.e., the support plate 81 may be elevated in a horizontal state through the scissor assembly 84.

The scissors assembly 84 may include a first scissors frame 841 in the form of a square frame and a second scissors frame 845 in the form of a rectangular frame rotatably connected to the first scissors frame 841 have.

The second scissors frame 845 may have a horizontal width less than that of the first scissors frame 841. Thus, the second scissors frame 845 may be connected to the first scissors frame 841 while being disposed within an area defined by the first scissors frame 841.

The first scissors frame 841 may include a lower shaft (see reference numeral 841*a* of FIG. 21) and an upper shaft (see reference numeral 841*b* of FIG. 23) extending in the horizontal direction.

The lower shaft (see reference numeral 841*a* of FIG. 23) may rotatably supported by the lower frame 83, and the upper shaft (see reference numeral 841*b* of FIG. 23) may be arranged to pass through the sliding guide 824 of the upper frame 82.

The first scissors frame 841 may be connected to a first rod (see reference numeral 841*a* of FIG. 23) and an upper shaft (see reference numeral 841*b* of FIG. 23) extending in the vertical direction.

The second scissors frame 845 may include a lower shaft 851*a* and an upper shaft, which extend in the horizontal direction and a first rod 852*a* and a second rod 852*b*, which extend in the vertical direction.

The first rod 842*a* of the first scissors frame 84 may have an extension part 842*b* protruding to be connected to the lever 42 and a coupling part 842*c* provided on an end of the extension part 842*b*.

The lever 42 may include an accommodation part 421*a* accommodating the coupling part 842*c* so as to be coupled to the coupling part 842*c*.

An end of the coupling part 842*c* may have a non-circular shape. Thus, the lever 42 may be prevented from being loosened with the coupling part 842*c* when the lever 42 rotates while the coupling part 842*c* is accommodated in the accommodation part 421*a*.

The coupling part 842*c* and the extension part 842*b* may extend to pass through the drawer opening 35, and the extension part 842*b* may be disposed on the drawer opening 35. The elevation device 80 inside the drawer part 32 may be connected to the driving device 40 outside the drawer part 32 by the extension part 842*b* and the coupling part 842*c*.

Hereinafter, a state in which the door 30 of the refrigerator 1 is inserted and withdrawn and is elevated according to an implementation will be described in more detail with reference to the accompanying drawings.

Figure 17:
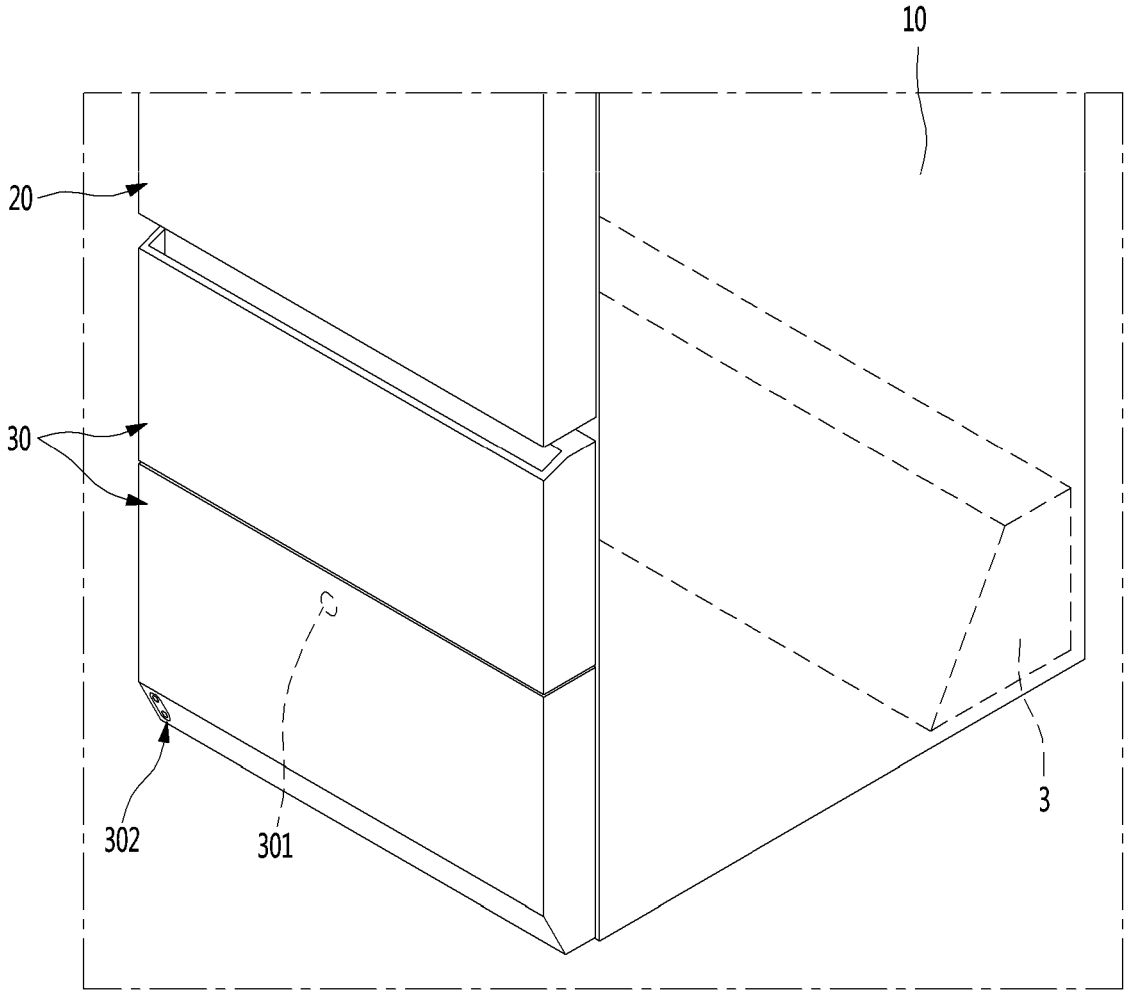
FIG. 17 is a perspective view illustrating a state in which the lower drawer door is closed.

FIG. 17 is a perspective view illustrating a state in which the lower drawer door is closed.

Referring to FIG. 17, in the state in which the food is stored, the refrigerator 1 may be maintained in a state in which all of the rotation door 20 and the door 30 are closed. In this state, the user may withdraw the door 30 to accommodate the food.

The door 30 may be provided in plurality in a vertical direction and be withdrawn to be opened by the user's manipulation.

Here, the user's manipulation may be performed by touching the manipulation part 301 disposed on the front surface of the rotation door 20 or the door 30. Alternatively, an opening command may be inputted on the manipulation device 302 provided on the lower end of the door 30.

Also, the manipulation part 301 and the manipulation device 302 may individually manipulate the insertion and withdrawal of the door 30 and the elevation of the elevation member 80. Alternatively, the user may hold a handle of the door 30 to open the drawer door 30.

Hereinafter, although the lower drawer door 30*b* of the doors 30, which are disposed in the vertical direction, is opened and elevated as an example, all of the upper and lower doors 30 may be inserted and withdrawn and elevated in the same manner.

Figure 18:
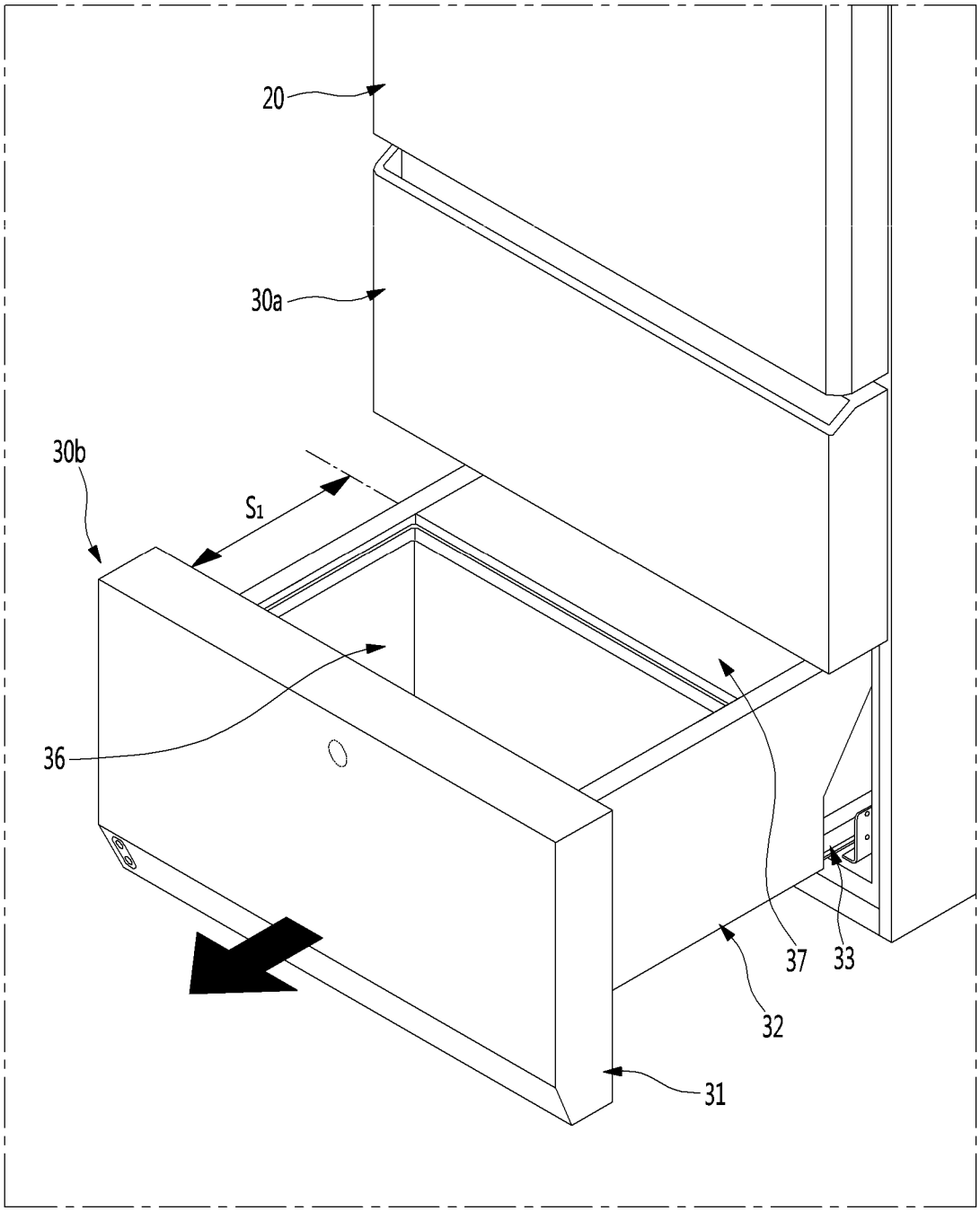
FIG. 18 is a perspective view illustrating a state in which the lower drawer door is completely opened.
Figure 19:
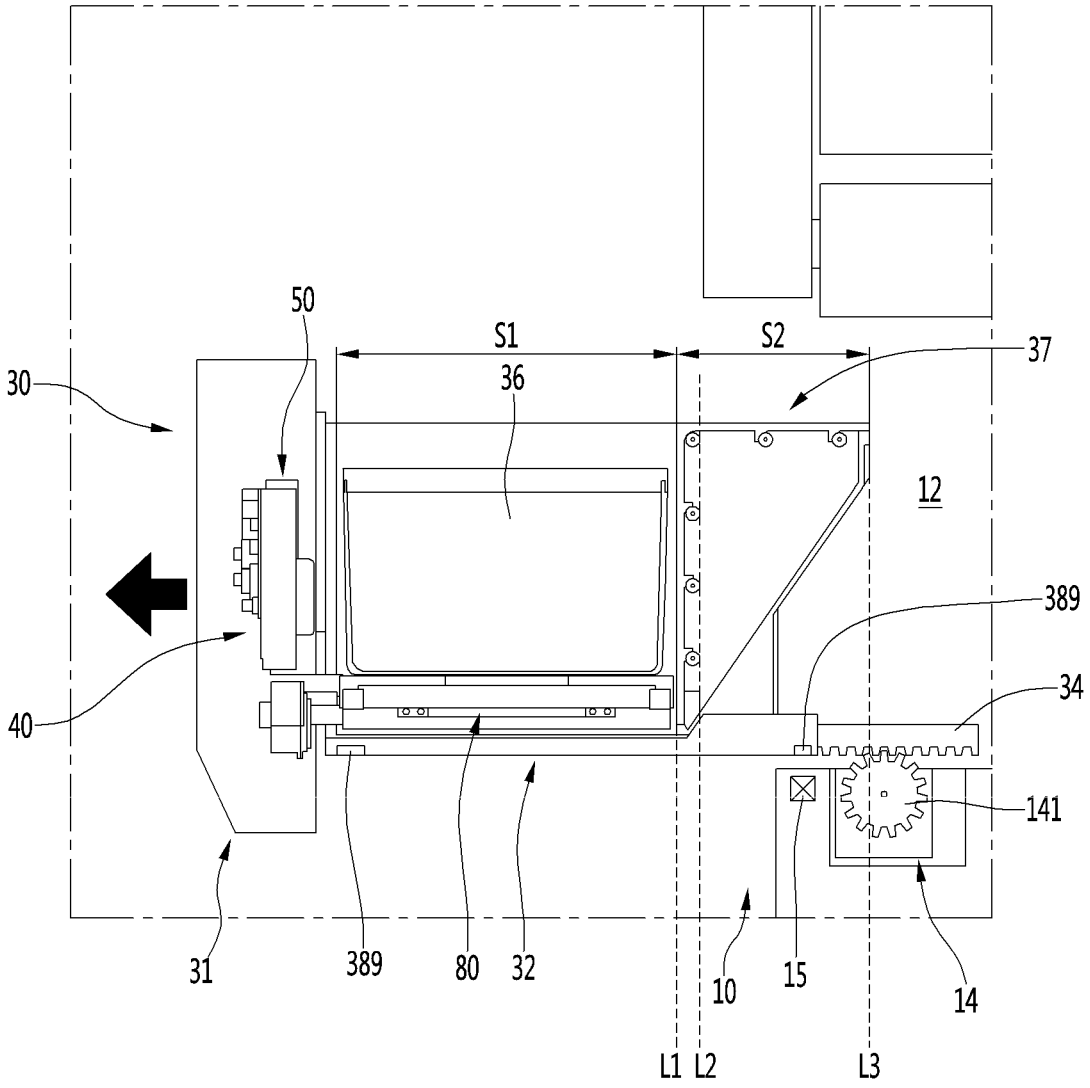
FIG. 19 is a cross-sectional view of the drawer door in a state in which a container of the lower drawer door completely descends.
Figure 20:
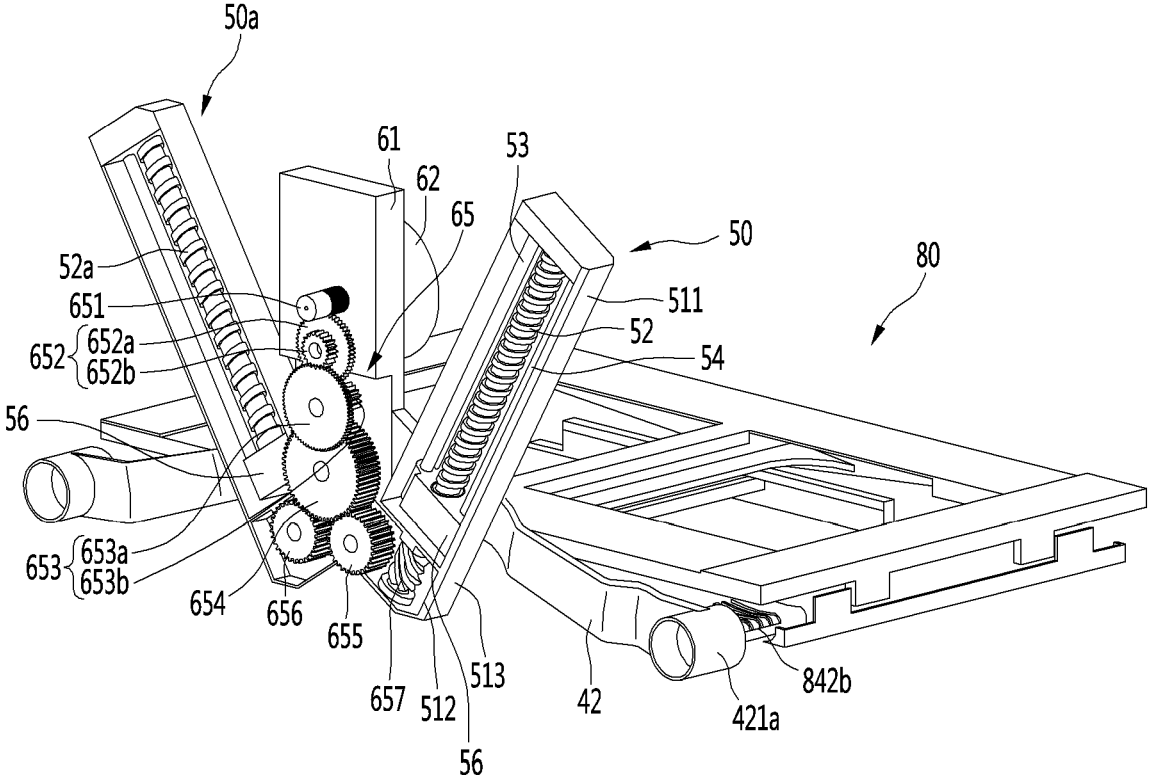
FIG. 20 is a perspective view illustrating states of the driving device and the elevation device in the state of FIG. 19.
Figure 21:
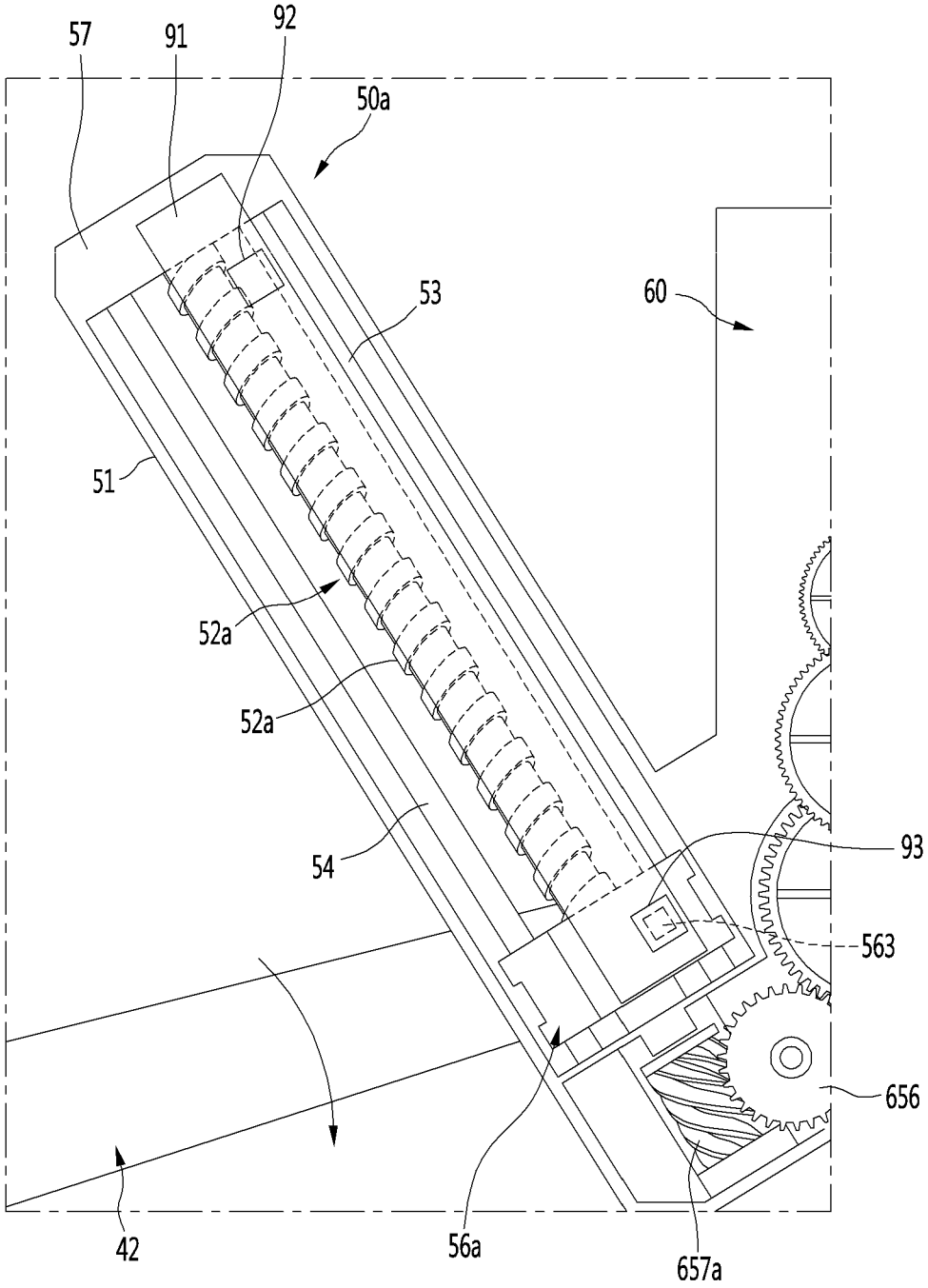
FIG. 21 is a view illustrating an elevation detection state in the state of FIG. 19.

FIG. 18 is a perspective view illustrating a state in which the lower drawer door is completely opened. Also, FIG. 19 is a cross-sectional view illustrating a state of the drawer door in a state in which the basket of the drawer door completely descends. Also, FIG. 20 is a perspective view illustrating states of the driving device and the elevation device in the state of FIG. 19. Also, FIG. 21 is a view illustrating an elevation detection state in the state of FIG. 19.

Referring to FIGS. 18 to 21, the user may manipulate the lower drawer door 30*b* to withdraw the lower drawer door 30*b* forward. The lower drawer door 30*b* may be withdrawn while the draw-out rail 33 extends.

The lower drawer door 30*b* may be configured to be inserted and withdrawn by the driving of the draw-out motor 14, not by a method of directly pulling the lower drawer door 30*b* by the user.

The draw-out rack 34 provided on the bottom surface of the lower drawer door 30*b* may be coupled to the pinion gear 141 rotating when the draw-out motor 14 provided in the cabinet 10 is driven. Thus, the lower drawer door 30*b* may be inserted and withdrawn according to the driving of the draw-out motor 14.

The draw-out distance of the lower drawer door 30*b* may correspond to a distance at which the front space S1 within the drawer part 32 is completely exposed to the outside. Thus, in this state, when the elevation device 80 is elevated, the container or the food may not interfere with the doors 20 and 30 or the cabinet 10 disposed thereabove.

Here, the draw-out distance of the lower drawer door 30*b* may be determined by a draw-out detection device 15 disposed on the cabinet 10 and/or the lower drawer door 30*b*.

The draw-out detection device 15 may be provided as a detection sensor that detects a magnet 389 to detect a state in which the lower drawer door 30*b* is completely withdrawn or closed.

For example, as illustrated in the drawings, the magnet 389 may be disposed on the bottom of the drawer part 32, and the detection sensor may be disposed on the cabinet 10. The draw-out detection device 15 may be disposed at a position corresponding to a position of the magnet 389 when the lower drawer door 30*b* is closed and a position of the magnet 389 when the lower drawer door 30*b* is completely withdrawn. Thus, the draw-out state of the lower drawer door 30*b* may be determined by the draw-out detection device 15.

Also, as necessary, a switch may be provided at each of positions at which the lower drawer door 30*b* is completely inserted and withdrawn to detect the draw-out state of the lower drawer door 30*b*. In addition, the draw-out state of the lower drawer door 30*b* may be detected by counting the rotation number of draw-out motor 14 or measuring a distance between the rear surface of the door part 31 and the front end of the cabinet 10.

In the state in which the lower drawer door 30*b* is completely withdrawn, the driving motor 64 may be driven to elevate the elevation device 80. The elevation device 80 may be driven in an even situation in which the lower drawer door 30*b* is sufficiently withdrawn to secure safe elevation of the food or container 36 seated on the elevation device 80.

That is, in the state in which the lower drawer door 30*b* is withdrawn to completely expose the front space S1 to the outside, the elevation device 80 may operate to prevent the container 36 or the stored food seated on the elevation device 80 from interfering with the doors 20 and 30 or the cabinet 10.

In details of the draw-out state of the lower drawer door 30*b*, the front space S1 has to be completely withdrawn to the outside of the lower storage chamber 12 in the state in which the lower drawer door 30*b* is withdrawn for the elevation.

Particularly, the rear end L1 of the front space S1 has to be more withdrawn than the front end L2 of the cabinet 10 or the upper door 20. Also, the rear end L1 of the front space S1 is disposed at a further front side than the front end L2 of the cabinet 10 or the door 20 so at to prevent the elevation device 80 from interfering when the elevation device 80 is elevated.

Also, when the elevation device 80 is completely withdrawn to be driven, the entire drawer part 32 may not be completely withdrawn but withdrawn up to only a position for avoiding interference when the elevation device 80 is elevated as illustrated in FIG. 19. Here, at least a portion of the rear space S2 of the drawer part 32 may be disposed inside the lower storage chamber 12. That is, the rear end L3 of the drawer portion 32 may be disposed at least inside the lower storage chamber 12.

Thus, even when the weight of the stored object is added to the weight of the lower drawer door 30*b* itself including the driving device 40 and the elevation device 80, the deflection or damage of the draw-out rail 33 or the lower drawer door 30*b* itself may not occur to secure the reliable draw-out operation.

The ascending of the elevation device 80 may start in a state in which the lower drawer door 30*b* is completely withdrawn. Also, to secure the user's safety and prevent the food from being damaged, the ascending of the elevation device 80 may start after a set time elapses after the lower drawer door 30*b* is completely withdrawn.

After the lower drawer door 30*b* is completely withdrawn, the user may manipulate the manipulation part 301 to input the ascending of the elevation device 80. That is, the manipulation part 301 may be manipulated to withdraw the door 30, and the manipulation part 301 may be manipulated again to drive the elevation device 80.

Also, in the state in which the lower drawer door 30*b* is manually inserted and withdrawn, the manipulation part 301 may be manipulated to drive the elevation device 80.

As illustrated in FIG. 19, the driving device 40 and the elevation device 80 may not operate until the lower drawer door 30*b* is completely withdrawn, and the elevation device 80 may be maintained in the lowest state.

In a state before the elevation device 80 ascends, the lever 42 and the screw holder may be disposed at the lowest position, and the elevation detection device 90 may detect this position to determine that the present state is a state in which the elevation device 80 completely descends.

In detail, the screw holder 56*a* may be disposed at the lowest position when the elevation device 80 completely descends. The magnet 563 provided in the screw holder 56*a* may be disposed at a position corresponding to the detection sensor 93 disposed below the pair of the detection sensors 92 and 93. The detection sensor 93 disposed below detects the magnet 563 to determine that the elevation device 80 completely descends.

When it is determined that the elevation device 80 completely descends by the elevation detection sensor 90, the driving device 40 may start an operation when the user's manipulation occurs or when the lower drawer door 30*b* is completely withdrawn.

If it is determined that the elevation device 80 does not completely descend, the elevation detection device 90 may output an abnormal signal, and thus, the driving device 40 may not operate.

Figure 22:
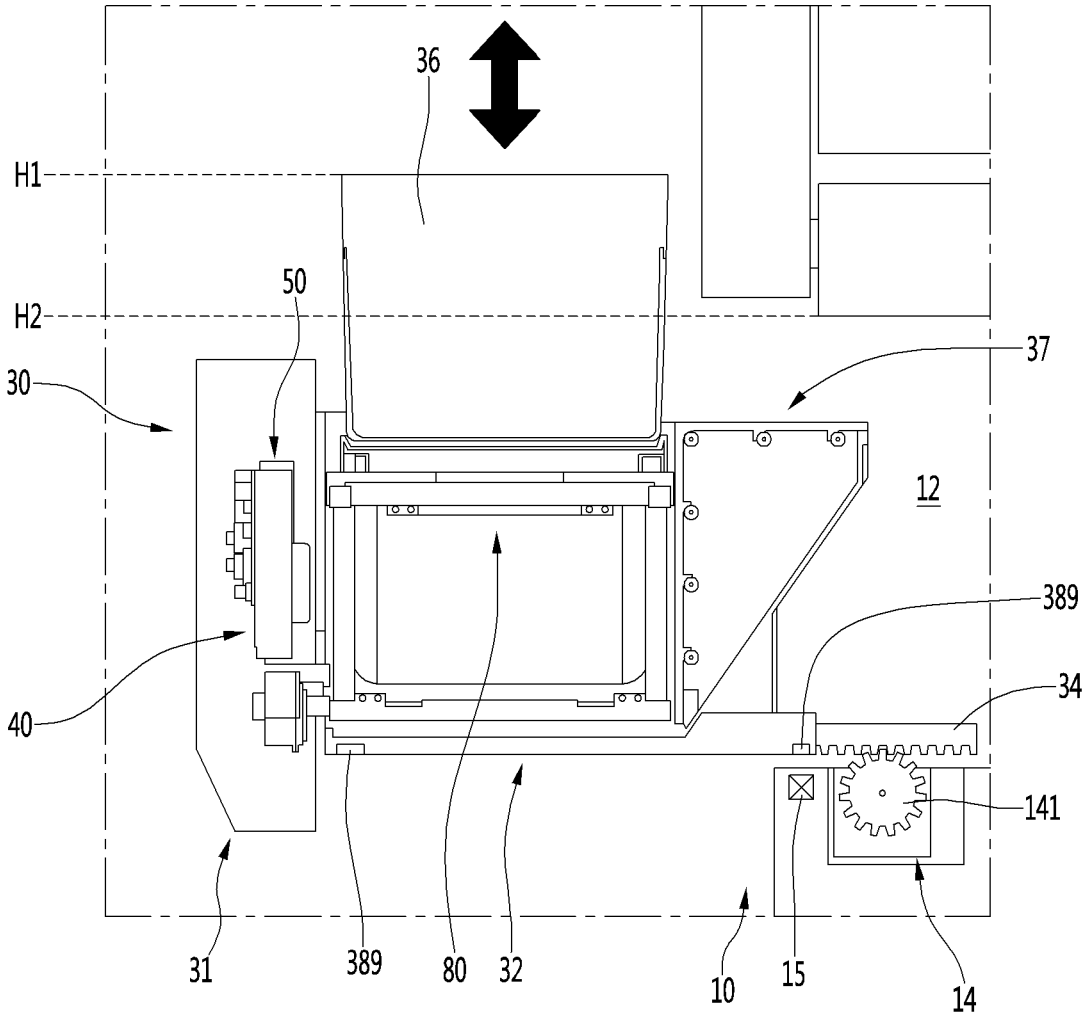
FIG. 22 is a cross-sectional view of the drawer door in a state in which the container of the lower drawer door completely ascends.
Figure 23:
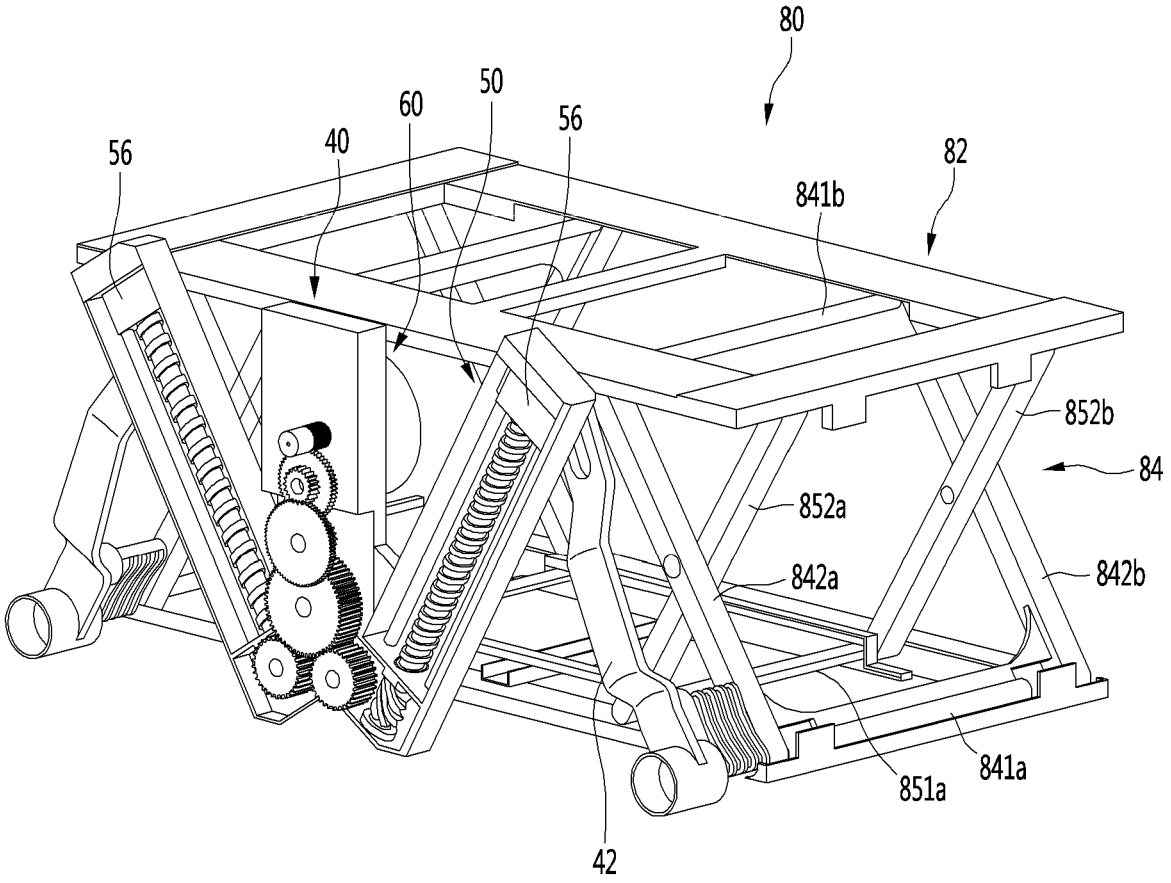
FIG. 23 is a perspective view illustrating states of the driving device and the elevation device in the state of FIG. 22.

FIG. 22 is a cross-sectional view of the drawer door in a state in which the container of the lower drawer door completely ascends. Also, FIG. 23 is a perspective view illustrating states of the driving device and the elevation device in the state of FIG. 22. Also, FIG. 24 is a view illustrating an elevation detection state in the state of FIG. 22.

Figure 24:
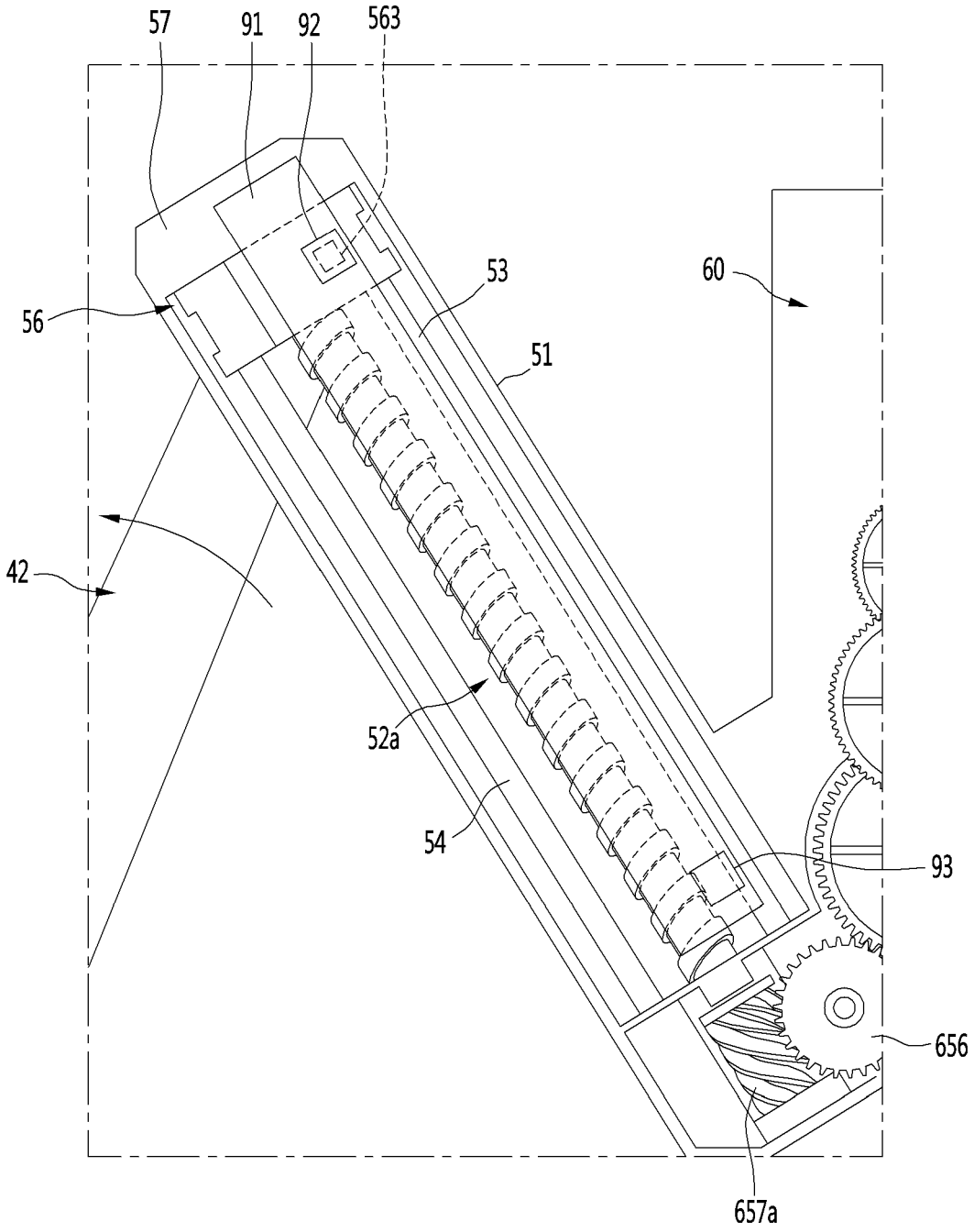
FIG. 24 is a view illustrating an elevation detection state in the state of FIG. 22.

Referring to FIGS. 22 to 24, in the state in which the lower drawer door 30*b* is withdrawn, when an operation signal of the driving device 40 is inputted, the driving device 40 may operate, and the state as illustrated in FIG. 22 may be obtained by elevating the elevation device 80.

In this implementation, the ascending of the elevation device 80 may mean that the upper frame 82 ascends by the scissors assembly 84, and the descending of the elevation device 80 may mean that the upper frame 82 descends by the scissors assembly 84.

The driving device 40 may be connected to the elevation device 80 so that the power is transmitted to the elevation device 80. The power may be transmitted to the elevation device 80 together with the operation of the driving device 40, and the elevation device 80 may start to ascend.

In detail, when the driving motor 64 rotates in the normal or reverse direction by the ascending/descending signal of the elevation device 80, the operation of the driving device 40 may start.

In details of the ascending operation of the elevation device 80, the driving gear 651 may rotate by the operation of the driving motor 64. The rotational force of the driving motor may be transmitted to the intersection gears 655 and 656 through the first to third transmission gears 652, 653, and 654 by the rotation of the driving gear 651.

The second helical gear parts 657 and 657*a* connected to the intersection gears 665 and 656 may rotate by the intersection gears 655 and 656 to change the power transmission direction. The screws 52 and 52*a* connected to the second helical gear parts 657 and 657*a* may rotate.

Since the same rotation force is transmitted to the screws 52 and 50*a* on both sides, the screw holders 56 and 56*a* may ascend by the same height.

As the screw holders 56 and 56*a* ascends, the lever 42 connected to the screw holders 56 and 56*a* may also rotate. The height of the lever 42 increases while the lever 42 connected to the screw holders 56 and 56*a* rotates, and the height of the first rod 842*a* of the first scissors frame 84 connected to the lever 42 may increase by the increase in height of the lever 42.

The scissors assembly 84 may be unfolded by the increase in height of the first rod 842*a* of the first scissors frame 84.

As a result, the scissors assembly 84 may be unfolded so that the upper frame 82 ascends, and the container 36 or the food placed on the support plate 81 may ascend, and finally, the elevation device 80 may ascend to its maximum height as illustrated in FIG. 22.

The elevation device 80 may continuously ascend and then be stopped when ascending to a sufficient height to facilitate the access to the food or container 36 seated on the elevation device 80 as illustrated in FIG. 22. In this state, the user may easily lift the food or container 36 without overtaxing the waist.

The lever 42 and the screw holder may be disposed at the highest position, and the elevation detection device 90 may detect the highest position to determine that the present state is a state in which the elevation device 80 completely ascends.

In detail, the screw holder 56*a* may be disposed at the highest position when the elevation device 80 completely ascends. Also, the magnet 563 provided in the screw holder 56*a* may be disposed at a position corresponding to the detection sensor 92 disposed above the pair of the detection sensors 92 and 93. The detection sensor 93 disposed below may detect the magnet 563 to determine that the elevation device 80 completely ascends to be in a state of completely ascending.

If it is determined that the elevation device 80 completely ascends by the elevation device 90, the driving motor 64 may be stopped. In this state, although the elevation device 80 is disposed inside the drawer part 32, the food or container seated on the elevation device 80 may be disposed at a position higher than the opened top surface of the drawer part 32. Thus, the user may easily access the food or container 36.

Particularly, it is not necessary to allow the waist excessively for lifting the container 36, so that it is possible to perform safer and more convenient operation.

In details of the maximally ascending state of the elevation device 80, the elevation device 80 may be disposed at least at a lower position than the upper end of the drawer part 32.

In the driving device 80, when viewed with respect to the container 36 in the state in which the container 36 is seated, the upper end H1 of the container 36 may ascend to a position higher than the upper end H2 of the lower storage chamber 12. Here, the height of the container 36 may reach a height suitable for the user to reach the container 36 without stretching his/her waist.

That is, the driving device 40 may have a structure in which the container 36 ascends from the inside of the drawer part 32. However, when the container 36 is mounted on the elevation device 80, the container 36 may be disposed at an accessible height.

After the user's food storing operation is completed, the user may allow the elevation device 80 to descend by manipulating the manipulation part 301. The descending of the elevation device 80 may be performed by reverse rotation of the elevation motor 64 and may be gradually performed through the reverse procedure with respect to the above-described procedure.

Also, when the elevation device 80 completely descends, the state shown in FIG. 19 may be obtained. The completion of the descending of the elevation device 80 may be also performed by the elevation detection sensor 90. When the magnet is detected by the detection sensor 93 disposed below, the elevation device 80 may determine that the descending is completed, and the driving device 40 may be stopped.

Also, after the driving of the elevation motor 64 is stopped, the lower drawer door 30*b* may be inserted. Here, the lower drawer door 30*b* may be closed by the user's manipulation or by the driving of the draw-out motor 14. When the lower drawer door 30*b* is completely closed, the state of FIG. 17 may be obtained.

In addition to the foregoing implementation, various implementations may be exemplified.

Hereinafter, another implementations will be described with reference to the accompanying drawings. In the other implementations of the present disclosure, the same reference numerals are used for the same components as those of the above-described implementations, and a detailed description thereof will be omitted.

Figure 25:
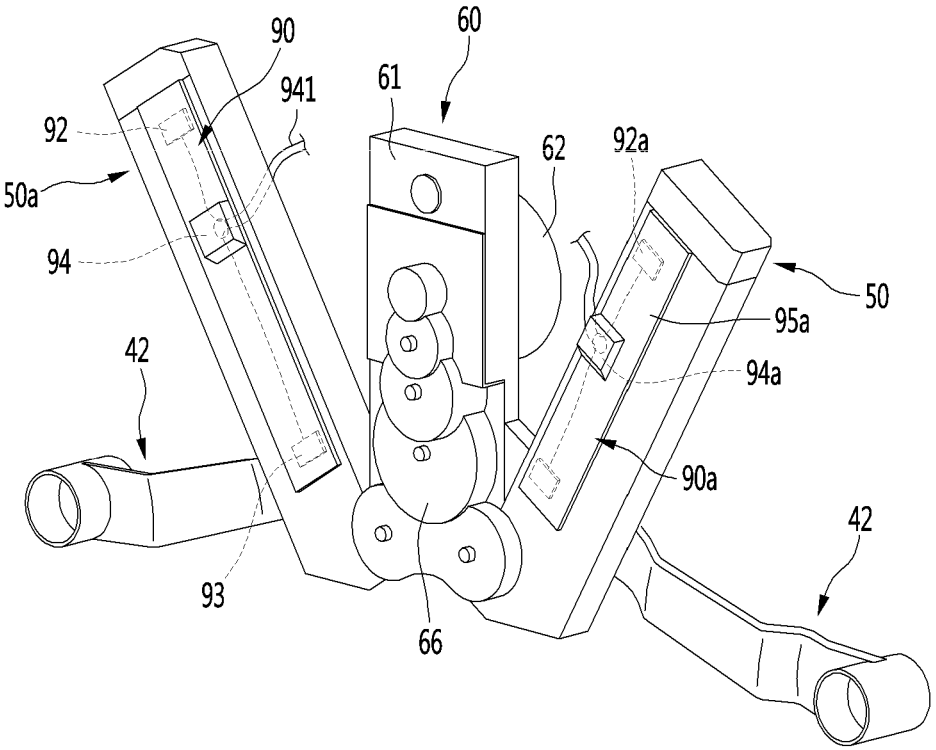
FIG. 25 is a rear perspective view of a driving device according to another implementation.

FIG. 25 is a rear perspective view of a driving device according to another implementation.

Referring to FIG. 25, a driving device according to another implementation may have the same structure as the driving device according to the forgoing implementation.

That is, the driving device 40 is provided with screw units 50 and 50*a* on both sides with respect to the motor assembly 60. A lever 42 may be disposed on each of the screw units 50 and 50*a*. The motor assembly 60, the screw units 50 and 50*a*, and the lever 42 may have completely the same structure, and thus, their detailed description will be omitted.

Also, elevation detection devices 90 and 90*a* may be disposed on both the screw units 50 and 50*a*, respectively. The elevation detection device 90*a* may have the same structure as the elevation detection device 90 according to the foregoing implementation, but the elevation detection devices 90 and 90*a* may be disposed on all both the screw units 50 and 50*a*.

For this, the elevation detection devices 90 and 90*a* may be disposed on both sides of the cover member 66.

The elevation detection devices 90 and 90*a* may include cases 95 and 95*a*, support plates 91 and 91*a*, and detection sensors 92, 92*a*, 93, and 93*a*. Also, since the elevation detection devices 90 and 90*a* are disposed on all both the screw units 50 and 50*a*, the magnet 563 may be disposed on each of all screw holders 56 and 56*a* of both the screw units 50 and 50*a*.

Thus, when the driving device 40 operates, both the elevation detection devices 90 and 90*a* may independently determine whether the elevation is completed. When both the elevation detection devices 90 recognizes the magnet 563 at the same time so that an elevation completion signal is inputted, this may be determined as a normal operation. However, if both the elevation detection devices 90 do not recognize the magnet 563 at the same time, it may be determined that the eccentricity occurs or determined as an abnormal state.

When it is determined as the abnormal state, the driving device 40 may be stopped or perform a return operation to output an abnormal signal so as to relocate a load or induce user's measures.

In addition to the foregoing implementation, various implementations may be exemplified.

Hereinafter, another implementations will be described with reference to the accompanying drawings. In the other implementations of the present disclosure, the same reference numerals are used for the same components as those of the above-described implementations, and a detailed description thereof will be omitted.

Figure 26:
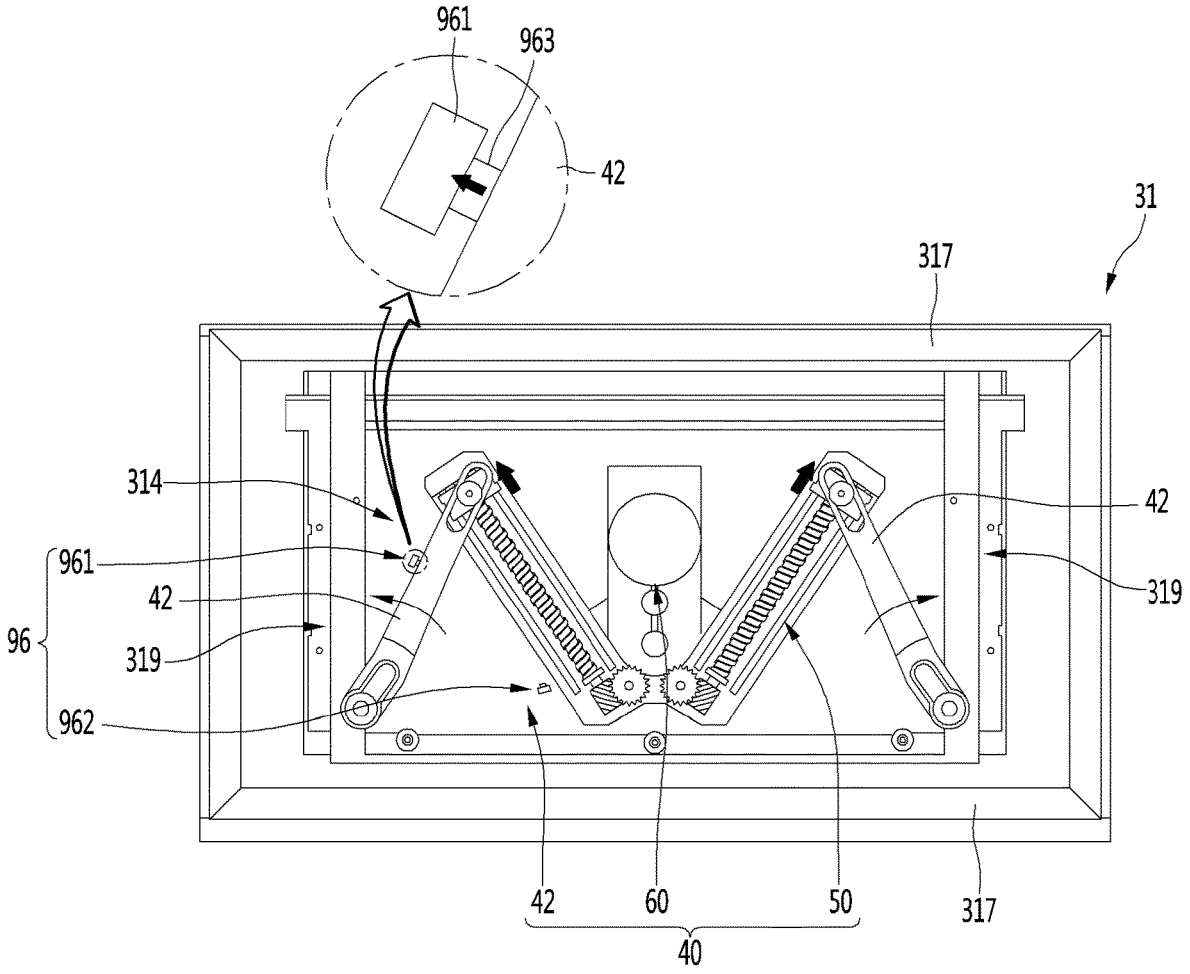
FIG. 26 is a rear view of a door part in a state in which an elevation device completely ascends according to further another implementation.

FIG. 26 is a rear view of a door part in a state in which an elevation device completely ascends according to further another implementation. Also, FIG. 27 is a rear view of a door part in a state in which the elevation device completely descends.

Figure 27:
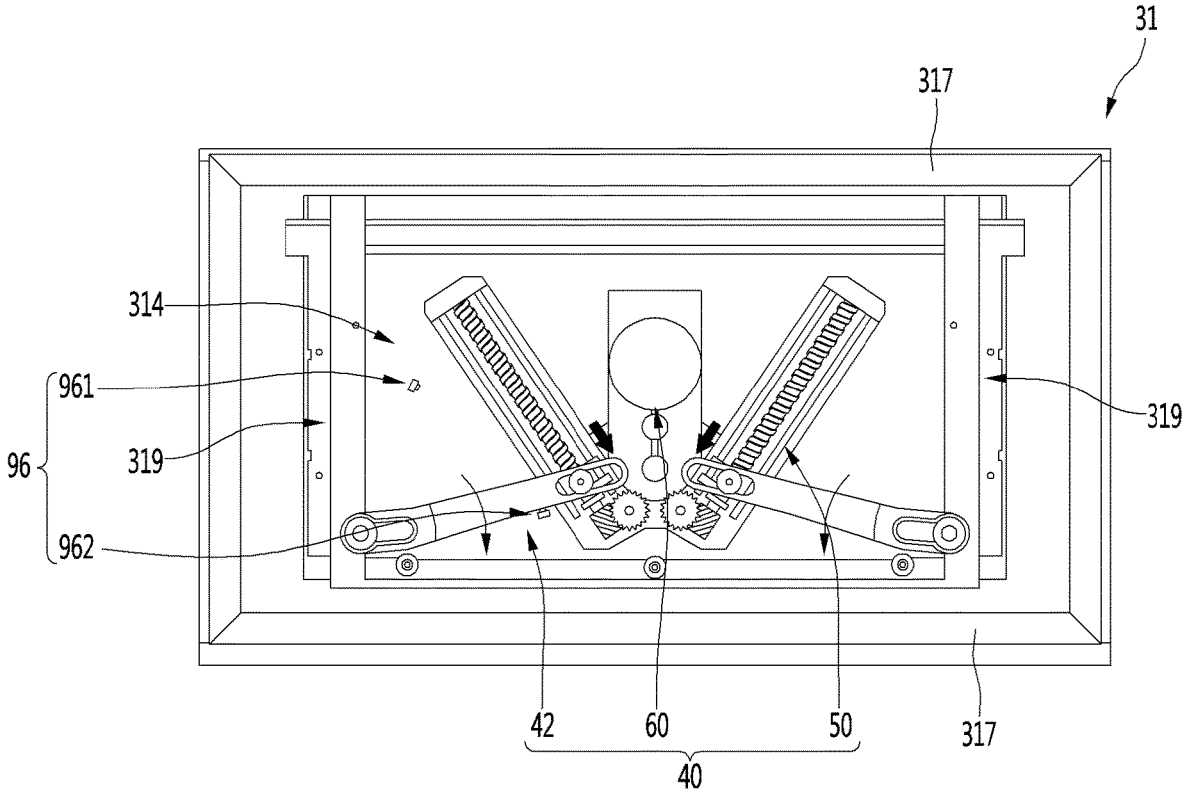
FIG. 27 is a rear view of a door part in a state in which the elevation device completely descends.

Referring to FIGS. 26 and 27, a driving device 40 may be disposed on a rear surface of a door part 31 according to further another implementation. The constituents of the driving device 40 are completely the same as that according to the foregoing implementation, and thus, detailed description thereof will be omitted.

The driving device 40 may be accommodated in a recessed portion of a door liner 314. The driving device 40 may include a pair of screw units 50 and 50*a* disposed on both sides with respect to a motor assembly 60 and a lever 42 connected to each of the pair of screw units 50 and 50*a*.

Also, an elevation detection device 96 may be disposed on a door part 31. The elevation detection device 96 may be disposed in a path along which the lever 42 rotates and be constituted by an upper detection device 961 and a lower detection device 962. Each of the upper detection device 961 and the lower detection device 962 may be provided as a switch to intuitively detect a position of the lever 42 when the lever 42 reaches a specific position.

When the elevation device 80 is disposed at the uppermost position, the upper detection device 961 may be disposed at a corresponding position of the lever 42. The upper detection device 961 may be disposed so that an input part 963 having a switch structure face a lower side so that the ascending lever 42 presses the upper detection device 961 to input an ascending completion signal.

When the elevation device 80 is disposed at the lowermost position, the lower detection device 962 may be disposed at a corresponding position of the lever 42. The lower detection device 962 may be disposed so that a protruding input part 963 having a switch structure face an upper side so that the descending lever 42 presses the lower detection device 962 to input an descending completion signal.

Since both the screw units 50 and 50*a* operate at the same time by the operation of one motor assembly 60, the elevation detection device 96 may detect a position of one lever of both the levers 42 to determine whether the elevation device 80 completely ascends or descends.

Alternatively, the elevation detection device 96 may be disposed at all both the levers 42.

As necessary, the elevation detection device may be a proximity sensor, an infrared sensor, or the like instead of the switch structure.

In addition to the foregoing implementation, various implementations may be exemplified.

Hereinafter, another implementations will be described with reference to the accompanying drawings. In the other implementations of the present disclosure, the same reference numerals are used for the same components as those of the above-described implementations, and a detailed description thereof will be omitted.

Figure 28:
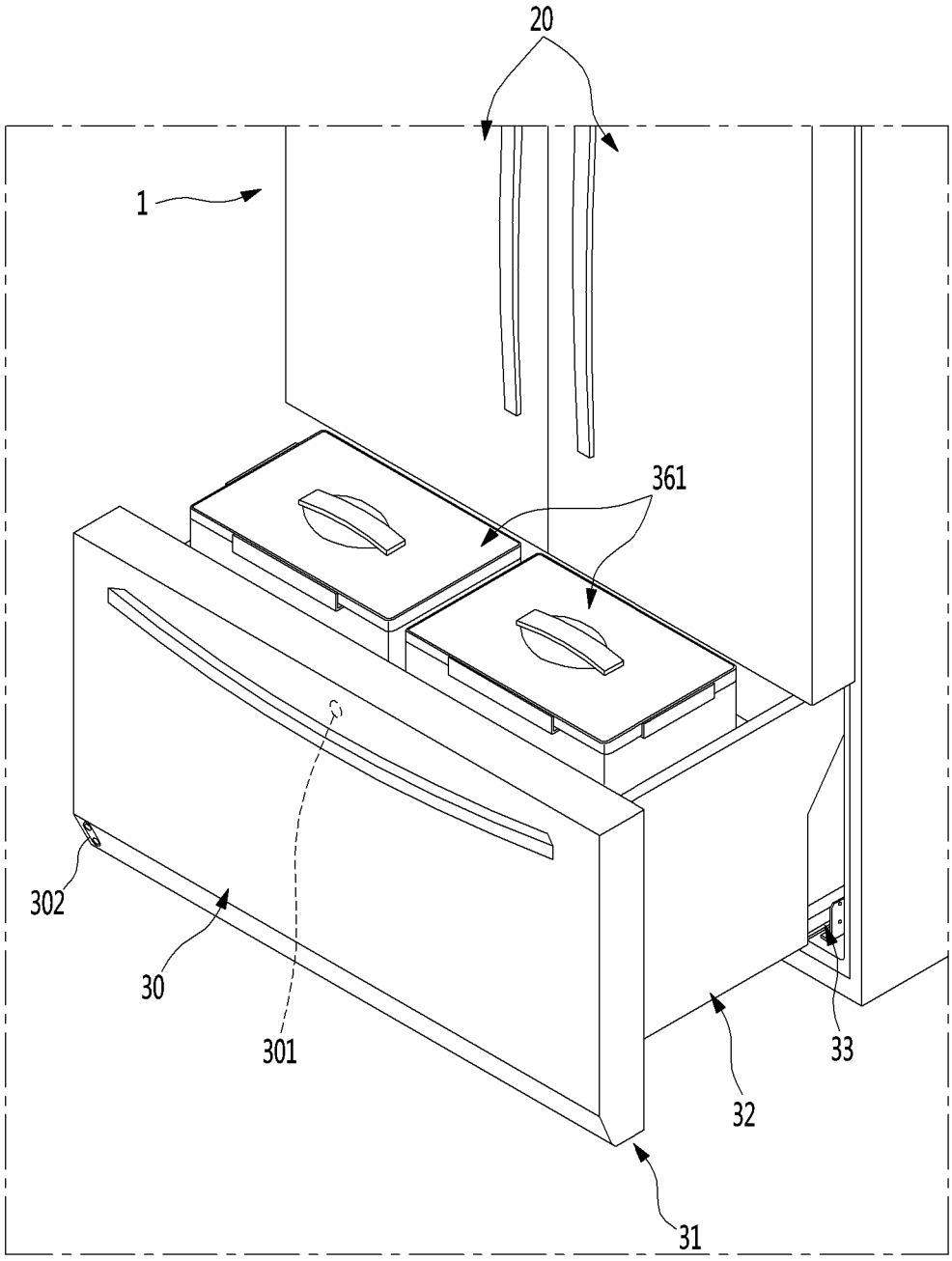
FIG. 28 is a perspective view of a refrigerator according to another implementation.

FIG. 28 is a perspective view of a refrigerator according to another implementation.

Referring to FIG. 28, a refrigerator 1 according to another implementation may include a cabinet 10 having a storage chamber that is vertically partitioned and a door opening and closing the storage chamber.

The door may include a rotation door 20 which is provided in an upper portion of a front surface of the cabinet 10 to open and close an upper storage chamber and a door 30 disposed in a lower portion of the front surface of the cabinet 10 to open and close a lower storage chamber.

The door 30 may be inserted and withdrawn forward and backward in the above implementation, and the container and the food inside the drawer part 32 may be vertically elevated by the operation of the driving device 40 and the elevation device 80 inside the door 30.

The elevation device 80 may be provided in the region of the front space of the inside of the drawer part 32. Thus, the elevation device 80 may elevate the food in the region of the front space among the entire region of the drawer part 32.

A manipulation part 301 or a manipulation device 302 may be provided at one side of the door part 31, and the driving part 40 may be installed inside the door part 31. Also, the pulling-out operation of the drawer door 30 and/or the elevation of the elevation device 80 may be carried out by the manipulation of the manipulation part 301 or the manipulation device 302.

The drawer part 32 may be provided with the elevation device 80. The elevation device 80 may be elevated by the driving device. Since the constituent of the drawer door 30 and constituent of the driving device 40 and the elevation device 80 are the same as those according to the foregoing implementation, their detailed descriptions will be omitted.

A plurality of containers 361 may be provided in the elevation device 80. The container 361 may be a sealed container such as a kimchi box, and a plurality of the containers 361 may be seated on the elevation device 80. The container 361 may be elevated together with the support plate 81 when the elevation device 80 is elevated.

Thus, in the state in which the container 361 ascends, at least a portion of the drawer part 32 may protrude, and thus, the user may easily lift the container 361.

The elevation device 80 may interfere with the rotation door 20 in the rotation door 20 is opened even though the drawer door 30 is withdrawn. Thus, the elevation device 80 may ascend in a state in which the rotation door 20 is closed. For this, a door switch for detecting the opening/closing of the rotation door 20 may be further provided.

Figure 29:
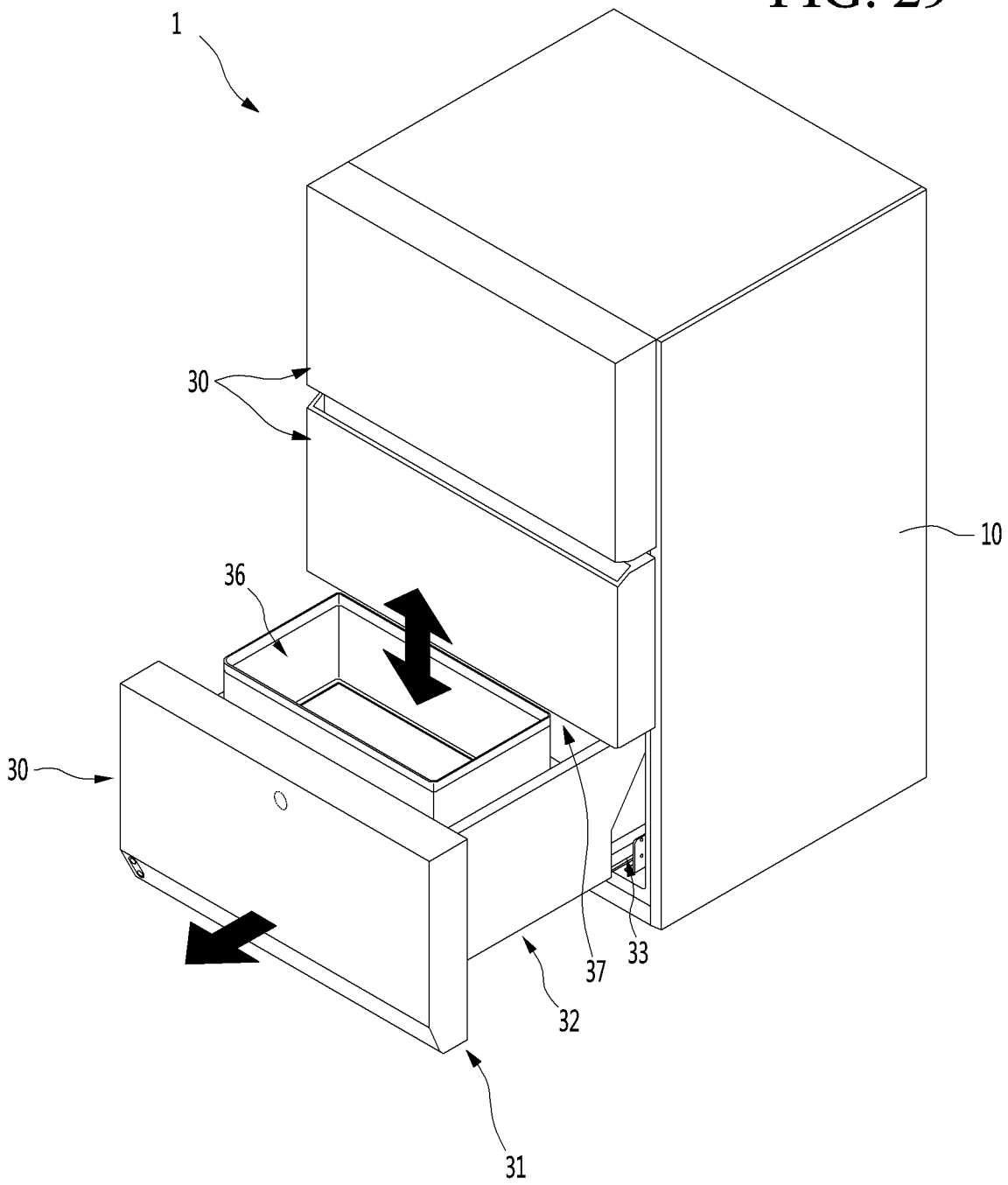
FIG. 29 is a perspective view of a refrigerator according to another implementation.

FIG. 29 is a perspective view of a refrigerator according to another implementation.

Referring to FIG. 29, a refrigerator 1 according to another implementation includes a cabinet 10 defining a storage chamber therein and a door opening and closing an opened front surface of the cabinet 10, which define an outer appearance of the refrigerator 1.

The door may include a drawer door 30 that defines an entire outer appearance of the refrigerator 1 in a state in which the door 2 is closed and is withdrawn forward and backward. A plurality of the drawer doors 30 may be continuously arranged in the vertical direction. Also, the drawer doors 30 may be independently withdrawn by the user's manipulation. The drawer door 30 may be provided with the driving device 40 and the elevation device 80.

The driving part 40 may be installed in the door part 31, and the elevation part 80 may be provided inside the drawer part 32. Also, the driving device 40 and the elevation device 80 may be connected to each other when the door part 31 and the drawer part 32 are coupled to each other.

Also, the elevation device 80 may be disposed in the front space S1 of the total storage chamber of the drawer part 32.

The insertion and withdrawal of the drawer door 30 and the elevation of the elevation device 80 may be individually performed. After the drawer door 30 is withdrawn, the elevation device 80 may ascend. Then, after the elevation device 80 descends, the insertion of the drawer door 30 may be continuously performed.

Also, when the plurality of drawer doors 30 are vertically arranged, the elevation device 80 inside the drawer door 30, which is relatively downwardly disposed, may be prevented from ascending in a state where the drawer door 30 is relatively drawn upward. Thus, the drawer door 30 may be prevented from interfering with the drawer door 30 in which the food and container are withdrawn upward.

Also, although the elevation device 80 ascends in the state in which the drawer door 30 that is disposed at the uppermost side is withdrawn in FIG. 29, all of the drawer doors disposed at the upper side may also be elevated by the elevation device 80 that is provided inside.

If a height of each of the drawer doors 30 disposed at the upper side is sufficiently high, only the drawer door 30 disposed at the lowermost position or the elevation device 80 of the of drawer doors 30 disposed relatively downward may be elevated.

Figure 30:
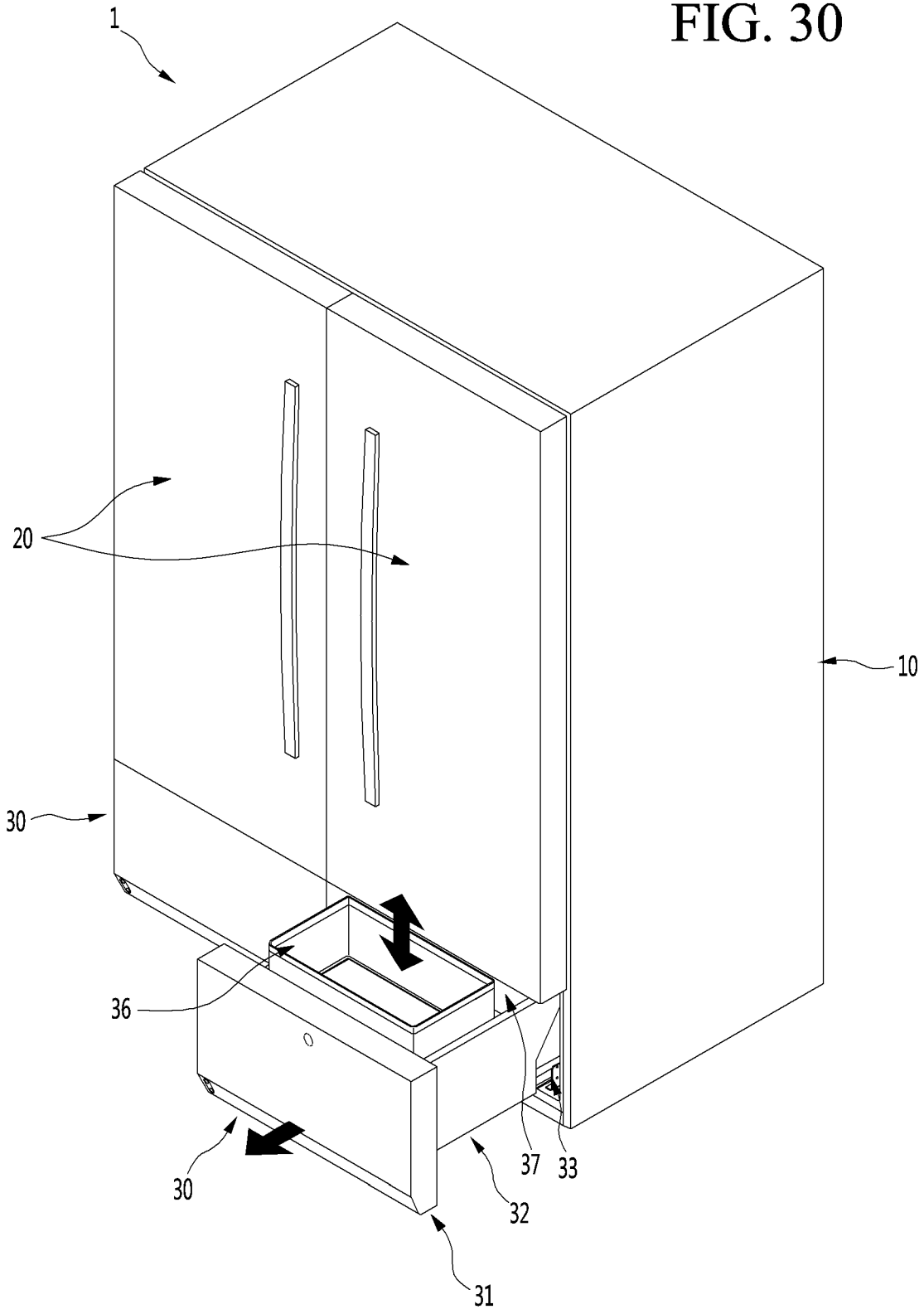
FIG. 30 is a perspective view of a refrigerator according to another implementation.

FIG. 30 is a perspective view of a refrigerator according to another implementation.

As illustrated in the drawings, a refrigerator 1 according to another implementation includes a cabinet 10 defining a storage chamber therein and a door opening and closing an opened front surface of the cabinet 10, which define an outer appearance of the refrigerator 1.

The inside of the cabinet 10 may be divided into an upper space and a lower space. If necessary, the upper and lower storage chambers may be divided again into left and right spaces.

The door may include a rotation door 20 which is provided in an upper portion of the cabinet 10 to open and close the upper storage chamber and a drawer door 30 disposed in a lower portion of the cabinet 10 to open and close the lower storage chamber.

Also, the lower space of the cabinet may be divided into left and right spaces. The drawer door 30 may be provided in a pair so that the pair of drawer doors 30 respectively open and close the lower spaces. A pair of the drawer doors 30 may be arranged on both sides of the right and left sides of the drawer door 30. The drawer door 30 may include the driving device 40 and an elevation device 80.

The driving part 40 may be installed in the door part 31, and the elevation part 80 may be provided inside the drawer part 32. Also, the driving device 40 and the elevation device 80 may be connected to each other when the door part 31 and the drawer part 32 are coupled to each other. Also, the elevation device 80 may be disposed in the front space S1 of the total storage chamber of the drawer part 32.

The drawer door 30 may have the same structure as the drawer door according to the foregoing implementation. Thus, the drawer door 30 may be inserted and withdrawn by user's manipulation. When the drawer door 30 is withdrawn, the support plate 81 may ascend so that a user more easily accesses a food or container within the drawer door 30.

The following effects may be expected in the refrigerator according to the proposed implementations of the present disclosure.

The refrigerator according to the implementation, the portion of the storage chamber within the drawer door may be elevated in the state in which the drawer door is withdrawn. Thus, when the food is accommodated in the drawer door disposed at the lower side, the user may not excessively turn its back to improve the convenience in use.

Particularly, in order to lift the heavy-weight food or the container containing the food, the user has to lift the food or container with a lot of power. However, the elevation within the drawer door may ascend up to a convenient position by driving the driving device to prevent the user from being injured and significantly improve the convenience in use.

Also, the driving device constituted by the electric devices for providing the power may be provided inside the door part, and the elevation device for the elevation may be provided inside the drawer part so that the driving device and the elevation device are not exposed to the outside to improve the outer appearance.

Particularly, the driving device constituted by the electric devices may be disposed inside the door part, and it may be possible to prevent the user from accessing the door to prevent the occurrence of the safety accident.

Also, the driving part that occupies a large portion of the entire constituents may be disposed in the door part to minimize the storage capacity loss of the drawer part. Also, the elevation device or the structure that is compactly folded and accommodated in the descending state may be provided to secure the storage capacity in the refrigerator.

Also, the driving device may be provided in the door to block the noise and reduce noise during the use.

Also, the elevation detection device that detects whether the elevation device is completely elevated may be provided to accurately determine the operation state of the elevation device. Particularly, the elevation detection device may be provided on the door part to detect the elevation state of the elevation device through the operation of the driving device. Thus, the elevation state of the elevation device may be accurately determined without providing the electric device in the drawer part.

Also, the user's inconvenience or the safety due to the malfunction of the elevation device may be prevented through the accurate determination of the elevation device.

Also, since the elevation detection device is disposed on the door part, all the electric devices on the drawer door may be disposed on the door part to improve the assembly workability through the modularization and improve the productivity.

In addition, when the service is required in the case of the abnormal situation or the inspection, the door part and the drawer part may be separated from each other to perform the service through the door part in which the electric device is installed, thereby remarkably improve the service performance.

Also, the drive device may be provided with the screw unit on both sides and provide the power to both sides of the elevation device to smoothly elevate the food or container having the high load.

Also, since both screw units have the driving force of one motor, the horizontal elevation of the elevation device without the separate control or constituent and without the deflection or tilting may be secured.

Also, the elevation detection device may detect the operations of the screw units, which transmit the power to both the sides, of the driving device to accurately determine whether the eccentricity of the elevation device occurs, thereby accurately detecting the abnormal situation.

Also, the driving device may disposed inside the door, and the elevation device may be disposed inside the drawer. Thus, the driving device and the elevation device may prevented from being exposed to the outside during the use, and the safety and the outer appearance may be further improved.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a storage chamber;

a drawer door comprising:

a drawer part configured to be inserted into and withdrawn out of the storage chamber, the drawer part defining an upwardly open storage space therein, and a door part coupled to the drawer part and configured to open and close the storage chamber;

a rail that slidably couples the drawer door to the cabinet;

a driving device provided in the door part and configured to provide a driving force;

an elevation device provided in the storage space of the drawer part and coupled to the driving device through the drawer part, the elevation device being configured to be actuated by the driving force to thereby vertically ascend or descend at least a portion of the elevation device, wherein the driving device comprises:

a motor assembly, a screw assembly comprising a screw and a screw holder, the screw being configured to be rotated by the motor assembly, the screw holder being configured to be moved along the screw based on a rotation of the screw, and a lever that couples the screw holder to the elevation device and is configured to be rotated based on the movement of the screw holder along the screw to thereby actuate the elevation device; and an elevation detection device disposed in the door part and configured to detect an operation state of the driving device to thereby determine whether the elevation device has completely ascended or descended.

2. The refrigerator according to claim 1, wherein the elevation detection device is provided at the driving device and is configured to detect a maximum height and a minimum height of the screw holder, respectively, to determine whether the elevation device has completely ascended or descended.

3. The refrigerator according to claim 2, wherein the screw assembly comprises:

a housing that accommodates the screw and the screw holder; and a cover member that covers an opened side of the housing, wherein the elevation detection device is disposed on the cover member.

4. The refrigerator according to claim 2, wherein the elevation detection device comprises:

a support plate that is elongated along an extension direction of the screw; and a pair of detection sensors disposed on upper and lower ends of the support plate at positions corresponding to uppermost and lowermost positions, respectively, of the screw holder along its movement path.

5. The refrigerator according to claim 4, wherein a magnet is disposed on the screw holder, and each of the detection sensors comprises a hall sensor configured to sense the magnet.

6. The refrigerator according to claim 4, wherein the support plate comprises a substrate on which the detection sensors are mounted.

7. The refrigerator according to claim 6, wherein a length of the substrate is greater than a stroke of the screw holder along its movement path.

8. The refrigerator according to claim 4, wherein the elevation detection device defines at least a portion of an outer appearance of the screw assembly and comprises a case that accommodates the support plate.

9. The refrigerator according to claim 8, wherein a connector mounting part on which a connector connected to the pair of detection sensors is mounted is disposed on one side of the case, and wherein the connector is connected to an electric wire that is exposed to an outside of the case through the connector mounting part.

10. The refrigerator according to claim 2, wherein the screw assembly comprises a pair of screw assemblies that are disposed, respectively, on a first side of the motor assembly and a second side of the motor assembly opposite the first side, and wherein the lever comprises a pair of levers that are connected, respectively, to each of the pair of screw assemblies to thereby actuate a first side of the elevation device and a second side of the elevation device opposite the first side at the same time.

11. The refrigerator according to claim 10, wherein the elevation detection device is disposed on one of the pair of screw assemblies.

12. The refrigerator according to claim 10, wherein the elevation detection device is disposed on each of the pair of screw assemblies.

13. The refrigerator according to claim 10, wherein the pair of screw assemblies are disposed symmetrically to each other with respect to the motor assembly, and wherein the pair of screw assemblies are oriented at an incline such that they become increasingly farther away from each other toward an upper side of the screw assemblies.

14. The refrigerator according to claim 10, wherein the elevation detection device is disposed in a rotation path of one of the pair of levers.

15. The refrigerator according to claim 1, wherein the elevation detection device is disposed in a rotation path of the lever to thereby detect a position of the lever.

16. The refrigerator according to claim 15, wherein the elevation detection device comprises a switch that is configured to contact the lever.

17. The refrigerator according to claim 15, wherein the elevation detection device comprises:

an upper detection device configured to contact the lever at a position corresponding to the uppermost rotation position of the lever; and a lower detection device configured to contact the lever at a position corresponding to the lowermost rotation position of the lever.

18. The refrigerator according to claim 15, wherein the screw assembly comprises a pair of screw assemblies that are disposed, respectively, on a first side of the motor assembly and a second side of the motor assembly opposite the first side, and wherein the lever comprises a pair of levers that are connected, respectively, to each of the pair of screw assemblies to thereby actuate a first side of the elevation device and a second side of the elevation device opposite the first side at the same time.

19. The refrigerator according to claim 1, wherein an accommodation part is provided in a rotation shaft of the lever, and wherein a coupling part that is detachably coupled to the accommodation part is disposed on the elevation device.

20. The refrigerator according to claim 19, further comprising a door cover disposed on a rear surface of the door part and configured to cover the driving device and the elevation detection device;

wherein a cover opening is defined in the door cover at a position corresponding to the accommodation part, and wherein a drawer opening is defined in a front surface of the drawer part at a position corresponding to the coupling part.

* * * * *